US011578485B2

(12) United States Patent
Claeys

(10) Patent No.: US 11,578,485 B2
(45) **Date of Patent: *Feb. 14, 2023**

(54) CURTAIN WALL AND WALL ELEMENT THEREBY APPLIED AND METHOD FOR MANUFACTURING SUCH A WALL ELEMENT

(71) Applicants: Stephanie Catharina R. Claeys, Zandhoven (BE); Laurens Leonard J. Claeys, Zandhoven (BE); Nausikaa Els P. Claeys, Zandhoven (BE)

(72) Inventor: Eric Claeys, Zandhoven (BE)

(73) Assignees: Stephanie Catharina R. Claeys, Zandhoven (BE); Laurens Leonard J. Claeys, Zandhoven (BE); Nausikaa Els P. Claeys, Zandhoven (BE)

( * ) Notice: Subject to any disclaimer, the term of this patent is extended or adjusted under 35 U.S.C. 154(b) by 0 days.

This patent is subject to a terminal disclaimer.

(21) Appl. No.: 17/349,098

(22) Filed: Jun. 16, 2021

(65) Prior Publication Data

US 2021/0310242 A1 Oct. 7, 2021

Related U.S. Application Data

(62) Division of application No. 16/337,133, filed as application No. PCT/IB2017/056531 on Oct. 20, 2017, now Pat. No. 11,066,829.

(30) Foreign Application Priority Data

Oct. 21, 2016 (BE) ..... 2016/5793
Oct. 27, 2016 (BE) ..... 2016/5808

(51) Int. Cl.
*E04B 2/96* (2006.01)
*E04B 2/88* (2006.01)
(Continued)

(52) U.S. Cl.
CPC ..... *E04B 2/965* (2013.01); *E04B 2/885* (2013.01); *E04B 2/90* (2013.01); *E04B 2/967* (2013.01); *E06B 3/5427* (2013.01)

(58) Field of Classification Search
CPC . E04B 2/965; E04B 2/885; E04B 2/90; E04B 2/967; E04B 2/96; E06B 3/5427
See application file for complete search history.

(56) References Cited

U.S. PATENT DOCUMENTS 4,021,987 A * 5/1977 Schnebel ..... E04B 2/96 52/235
4,525,963 A * 7/1985 Gartner ..... E04B 2/90 52/235

(Continued)

FOREIGN PATENT DOCUMENTS

CN 1886565 A 12/2006
CN 202809924 U 3/2013

(Continued)

OTHER PUBLICATIONS

International Search Report in related PCT/IB2017/056531, dated Mar. 12, 2018.

(Continued)

*Primary Examiner* — Jessie T Fonseca
(74) *Attorney, Agent, or Firm* — Bacon & Thomas, PLLC

(57) ABSTRACT

A curtain wall constructed from prefabricated connecting wall elements mounted in rows next to and above each other with the wall elements including a frame of assembled profiles on the inside of the curtain wall and of one or more infill elements on the outside of the curtain wall. The frame contains mullions and transoms in the form of profiles which along the perimeter of the frame have female coupling parts and male coupling parts which allow the adjacent mullions and adjacent transoms in an assembled condition in the curtain wall to engage with their coupling parts to form (Continued)

composite basic profiles, where between two rows of connecting wall elements a horizontal seal has been applied which extends continuously in a horizontal direction over the width of the underlying row.

20 Claims, 25 Drawing Sheets

(51) Int. Cl.
*E06B 3/54* (2006.01)
*E04B 2/90* (2006.01)

(56) References Cited

U.S. PATENT DOCUMENTS 4,599,838 A * 7/1986 Kaminaga ..... E04B 2/90 52/235
4,619,092 A * 10/1986 Kaminaga ..... E04B 2/96 52/302.1
5,355,645 A * 10/1994 Farag ..... E06B 3/5427 52/235
5,381,637 A * 1/1995 Farag ..... E06B 3/5427 52/204.593
5,579,616 A * 12/1996 Farag ..... E04B 2/96 52/311.1
7,832,160 B2 * 11/2010 Farag ..... B32B 17/069 52/235
8,484,916 B2 * 7/2013 Farag ..... B32B 17/10366 52/204.5
8,991,121 B1 3/2015 Baker
2015/0284950 A1 10/2015 Stramandinoli
2016/0053487 A1 * 2/2016 Frederick ..... E04B 2/90 52/235
2017/0298621 A1 * 10/2017 Frederick ..... E04B 2/967
2019/0078380 A1 * 3/2019 McKenna ..... E06B 3/5481
2019/0264491 A1 * 8/2019 McKenna ..... E06B 3/26
2020/0032575 A1 * 1/2020 Koster ..... E06B 3/9616

FOREIGN PATENT DOCUMENTS

CN 202809928 U 3/2013
EP 0569876 A1 11/1993
EP 1643049 A2 5/2006
GB 2127454 A * 4/1984 ..... E04B 2/90
GB 2143558 A 2/1985
GB 2582045 A * 9/2020 ..... E04B 2/88
KR 1020120028478 3/2012
WO 2013091318 A1 6/2013
WO WO-2018073800 A1 * 4/2018 ..... E04B 2/885

OTHER PUBLICATIONS

Written Opinion in related PCT/IB2017/056531, dated Mar. 12, 2018.
Belgium Search Report in related Belgium Application No. 201605808, dated Dec. 16, 2016.
Chinese Office Action and Search Report in corresponding Chinese Application No. 2017800643830, dated Jun. 10, 2020.
EP Office Action in corresponding EP Application No. 17801107.8, dated Sep. 28, 2021.

* cited by examiner

CURTAIN WALL AND WALL ELEMENT THEREBY APPLIED AND METHOD FOR MANUFACTURING SUCH A WALL ELEMENT

CROSS REFERENCE TO RELATED APPLICATIONS

This application is a divisional application of U.S. application Ser. No. 16/337,133, filed Mar. 27, 2019, which is the national stage entry of International Application PCT/IB 2017/056531, filed Oct. 10, 2017, which claims priority to Belgian application BE 2016/5793, filed Oct. 21, 2016 and Belgian application BE 2016/5808, filed Oct. 27, 2016, which are all incorporated by reference.

FIELD OF THE INVENTION

The current invention relates to a curtain wall.

The current invention relates more specifically to a curtain wall of the modular type, typically constructed from rectangular prefabricated wall elements which are connected to each other sideways with seals in horizontal rows extending one above the other.

BACKGROUND OF THE INVENTION

Such type of curtain walls whereby the wall elements are connected using seals between the wall elements is already known.

The wall elements are made of a frame of assembled aluminium profiles on the inside of the curtain wall and infill elements, e.g. glass or other infill elements which are attached on the outside of the curtain wall against the aluminium frame with structural glue.

In this technique the glazing is only glued to the aluminium frame using structural silicone and the glass is thus not mechanical attached.

An advantage of prefabricated wall elements is that they can be manufactured under ideal and controlled conditions in a factory, which is obligatory under the relevant norms and regulations when it comes to structural glazing 30 attached with a structural glue.

The wall elements are such that the glued glazing or other infill elements entirely or almost entirely cover the outside of the frames so that it appears from the outside as if the curtain wall is made only of glass or other infill elements whereby the frame is hidden behind the infill elements. Therefore, on the outside one only sees a glass surface or other infill elements and nothing of the structure in any material.

Such wall elements are suspended in their entirety to the basic structure of the building and connect to each other to form one continuous outer wall, whereby a wall element spans at least the height of one storey and typically contains two infill elements glued one on top of the other on the frame, namely one single infill element that is non-translucent or opaque and that covers the rough floor structure between the floors and a see-through infill element forming a window on the relevant floor.

From U.S. Pat. No. 8,991,121, non-thermally broken façade elements are known, which consist of a frame of assembled aluminium profiles on the inside of the curtain wall and infill elements, e.g. glass or other infill elements on the outside of the curtain wall.

This curtain wall is made watertight using silicones, which is at odds with the aim of the current invention where no silicones have to be used.

In this U.S. Pat. No. 8,991,121, silicones are indeed applied on different levels.

For example, the wall elements of U.S. Pat. No. 8,991,121 at the top and bottom are provided with complementary male and female coupling parts thanks to which the wall elements slide into each other in a vertical and lateral direction, whereby e.g. the horizontal coupling parts are sealed using horizontal seals which are interrupted between two sideways adjacent wall elements.

The openings between the seals which extend horizontally in each other's extension are filled with silicones when the curtain wall is assembled on site.

The vertical gap between two sideways adjacent wall elements is also sealed at the top by a horizontal layer of silicones which is smeared out at the adjacent top corners of the wall elements to bridge the vertical gap.

These silicone sealants should not be used in wall building in view of the fact they are not durable and as a result can tear off when the wall elements move, e.g. following expansion and contraction due to changes in temperature. If that happens it is no longer possible to repair or replace the silicone sealant.

Moreover, applying silicones in at times unfavourable working conditions on site increases the risk of a bad installation because the adhesion of the silicones on the 30 profiles is more likely to be bad quality and therefore can be a possible cause of later leaks and moisture infiltrations.

Moreover, in this curtain wall described in U.S. Pat. No. 8,991,121, screws are used in a certain embodiment for the attachment relative to each other of horizontal profiles, and these screws go straight through the layer of silicones and thus can also cause the necessary leakages. The fact that in this application a joint gutter with weep holes is provided shows that leakages are to be expected in this curtain wall.

Moreover, the aforementioned screws go through the insulation profiles between the frame profiles to be connected and thus form unwanted thermal bridges.

The profiles used in U.S. Pat. No. 8,991,121 for the transoms comprise several profiles which in the corners of the wall elements connect differently on each other and the mullions resulting in a complex assembly which is impossible or difficult to automate.

In other known walls, traditionally the profiles of the frames are, at the level of the corners of the wall elements, mitred with each other using corner pieces the legs of which are stuck in the aluminium profiles and the frames are connected to each other and made watertight using seal rubbers that sit in the recesses of two adjoining wall elements. Such wall elements are known from EP 0.569.876 for instance. In these traditional systems seal rubbers are cut to size on site to the height and the width of a wall element and subsequently pushed into the aforementioned recesses.

In these known traditional systems seal rubbers are cut at the level of the ends to a half thickness, so that at the level of the corners these ends overlap each other and connect. This is a very delicate operation requiring great professionalism and is often done badly, which can have dire consequences in terms of leak, particularly in case of high wind pressure as is often the case for floors at great height. In addition, special tools need to be used to couple the wall elements.

Consequently, all this requires considerable working hours and professionalism to build a curtain wall and the chances of an incorrect assembly are also greater.

Moreover, traditional wall systems have a large number of different parts.

In addition, the tightness of the curtain wall against water infiltration is realised by a multiple cascade system whereby the rainwater is drained down vertically, which means you have no control over the drainage.

Also, such cascade system requires cuts or recesses to be made in certain places in the seal rubbers In the case of EP 0.569.876, the glass infill elements are clamped in the frame between support profiles on the inside of the wall and cover profiles on the outside of the wall. The cover profiles are visible on the outside of the wall.

Moreover, in the case of this EP 0.569.876 the assembly by sliding two adjacent wall elements sideways into each other with intermediate seals, more specifically three seals in every direction, is extremely difficult and delicate to impossible.

The present invention aims to provide a solution for at least one of the aforementioned and other disadvantages.

SUMMARY OF THE INVENTION

To this end, the invention relates to a curtain wall of the modular type, constructed from prefabricated connecting wall elements mounted in rows next to and above each other, characterised in that the wall elements consist of a frame of assembled profiles on the inside of the curtain wall and of one or more infill elements on the outside of the curtain wall whereby the frame contains mullions and transoms along the perimeter which are provided with female coupling parts and male coupling parts which allow the adjacent mullions and adjacent transoms in an assembled condition in the curtain wall to engage telescopically with each other with their coupling parts to form composite basic profiles whereby between two rows of connecting wall elements a horizontal seal is applied, which extends continuously in a horizontal direction over several wall elements along the length of an underlying row, whereby the horizontal seal is a continuous flexible sealing profile, from EPDM or similar material, with a part with which the horizontal seal rests on an underlying wall element and an upstanding edge which in an assembled condition extends into the female coupling part of the lowest transom of the wall elements above and which with this upstanding edge clamps and seals between this male coupling part of an underlying row of wall elements on which the horizontal seal rests and the female coupling parts of the row of wall elements above.

In this way, the frames of the wall elements can be simply slid into each other telescopically with their coupling parts, without the time-consuming application of seal rubbers and they can be made airtight and waterproof in one go.

By the uninterrupted horizontal seal between two rows of wall elements, the wall elements are segmented and insulated from each other row per row in terms of water drainage, whereby the disadvantages of the traditional cascade system can be avoided.

Furthermore, the construction of such a curtain wall is very simple, whereby first a full row of wall elements is mounted, after which the uninterrupted horizontal seal above this row is applied to then be able to install the next row of wall elements. In so doing, the curtain wall is built up row per row and the construction of a high curtain wall is thus reduced to stacking on top of one another horizontal rows of modules guaranteeing complete wind and water tightness relative to one another.

Preferably, the horizontal seal is executed as a profile made from rubber or the like with a substantially flat part with which the horizontal seal rests on an underlying wall element and an upstanding edge which in an assembled condition of the curtain wall extends into the female coupling part of the bottom transom of the wall elements above.

The upstanding edge thus forms a barrier for the possible infiltration of water from the outside to the inside.

According to a preferred embodiment, the upstanding edge is sealed and clamped between the male coupling parts of an underlying row of wall elements and the female coupling parts of the row wall of elements above.

The upstanding edge thus forms a seal between the profiles.

Preferably, the upper transom of the wall elements is fitted with a U-shaped male coupling part with upstanding legs that extend into the female coupling part of a higher wall element and the upstanding edge of the horizontal seal is fitted with a hook-shaped bent end that grips over one of the upstanding legs and that prevents the upstanding edge from being pushed down when a wall element, when assembling the curtain wall, is placed on an underlying wall element.

The flat part of the horizontal seal preferably slopes down to the outside to allow a good transit of water in case of rain or the like.

The wall elements are fitted along their perimeter with thermal insulation profiles which are attached to the frame and overlap towards the outside reaching over the edges of the infill elements, with the insulation profiles being sealed against the infill elements using silicones or another sealing kit.

Preferably, the wall elements are sealed relative to each other on four different levels, whereby each level is realised at a different distance from the outside of the curtain wall.

Preferably, the wall elements consist of mullions and transoms with perpendicular ends, whereby the transoms extend between the mullions and are connected to them using screws.

The sealing on four levels in combination with the technique of thermal break means infiltration moisture from outside can never come into contact with the screwed corner connections of the wall elements.

This simplifies the assembly of the frames of the wall elements compared to the frames with mitre connections and also allows the assembly to be automated.

According to another special aspect of the invention, the infill elements are attached on the frame using aluminium slats which on assembly of the wall elements can be slid with a foot lengthways in a complementary groove of the profiles and against which the infill elements can be attached using structural glue.

This aspect also allows the production of the wall elements to be automated.

The slats against which the infill elements are glued structurally are anodised and technically certified for application of structural silicone in accordance with the applicable laws and standards.

The invention also relates to a wall element to construct a curtain wall according to the invention and which allows application of the aforementioned advantages of a curtain wall according to the invention.

Essential elements of the invention can thus be summarised as follows:

1/A continuous horizontal seal, across several modules and applied AFTER installation of such a row of modules and this on the top thereof, whereby this seal extends from a surface behind the coupling of the modules or wall elements to the front of these modules, due to which the following characteristics are simultaneously achieved:

The corner connections of the modules are completely shielded by means of the central seal rubber, resulting in an additional proofing guarantee;

At the top of the modules there is no free "seam" or joining of profiles in contact with the outside. The continuous seal rubber acts like a continuous sill at the top of the modules due to which perfect waterproofing is guaranteed;

Any infiltration water that might possibly infiltrate via the vertical joints can SOLELY be carried away per row of modules and MUST therefore leave per module. Infiltration water CANNOT cascade down via gravitation or so-called cascade;

On the "back", this seal is fitted with a high vertical ridge, which de facto also continues uninterruptedly over a row of several modules, which as a result of the telescopic technique of the module connection, connects seamlessly with and perfectly sits between the hanging down leg of the female coupling part of the row of modules above, on the one hand, and the upstanding leg of the male coupling part of the underlying row, thus achieving perfect waterproofing;

The seal is clamped in several places in an underlying wall element such that a good connection and fixation is ensured, preferably on three different levels.

2/ the seal is placed as a continuous sealing profile from EPDM or the like whereby the fitters do NOT have to make cut-outs or local recesses, which is the case in all classic existing systems with the major risk of a faulty execution. The supplied profile can be rolled out and clamped WITHOUT any modification into the provided grooves. This means no special tools need to be used or any special installation instructions need to be followed either. The fitter does not need any expertise to apply the seal and mistakes are impossible.

The invention also relates to a method to produce such wall elements in an automated production line.

The method comprises the following steps:

a/ sawing all the profiles of the mullions and transoms and the insulation profiles to the right length;

b/ machining, and if necessary grinding, the profiles using an automated machining device c/ positioning the profiles on the production line with the inside of the mullions and transoms facing downwards in a position relative to a frame under fabrication of the wall element d/ sliding in the aluminium slats to allow structural gluing of the infill elements;

e/ assembling the frames by placing the screws to connect the mullions with the transoms and installing all seals;

f/ installing the infill elements on the aluminium slats g/ applying the structural silicone to attach the infill elements to the aluminium slats;

h/ placing and securing the insulation profiles for the thermal break;

i/ sealing the insulation profiles along the edges of the infill elements with the help of a silicone or other sealing kit.

The advantage of this method is that wall elements can be produced in an automated way in a much shorter time compared to the known systems and that the wall elements have already been fitted with all the seals beforehand in a controlled way, with the exception of the horizontal seal between two consecutive rows wall elements.

In this way, the use of any form of silicones can be avoided, which for decades was a problem in the technology of curtain walls, and the wall elements can be simply slid into each other with their complementary male and female coupling parts without requiring screws or other mechanical connections.

BRIEF DESCRIPTION OF THE DRAWINGS

With the intention of better showing the characteristics of the invention, a preferred embodiment of a modular curtain wall and wall elements thereby applied is described hereinafter, by way of an example without any limiting nature, with reference to the accompanying drawings wherein:

FIG. 3 shows a cross-section according to the line in FIG. 1;

FIGS. 11 to 14 show cross-sections according to the lines XI-XI to XIV-XIV in FIG. 10, however in FIGS. 11 and 14 with a wing that opens;

FIGS. 23 and 24 respectively show a cross-section according to the lines XXIII-XXIII and XXIV-XXIV in FIG. 20 but after the replacement of the damaged 25 infill element.

DETAILED DESCRIPTION OF THE INVENTION

Figure 1:
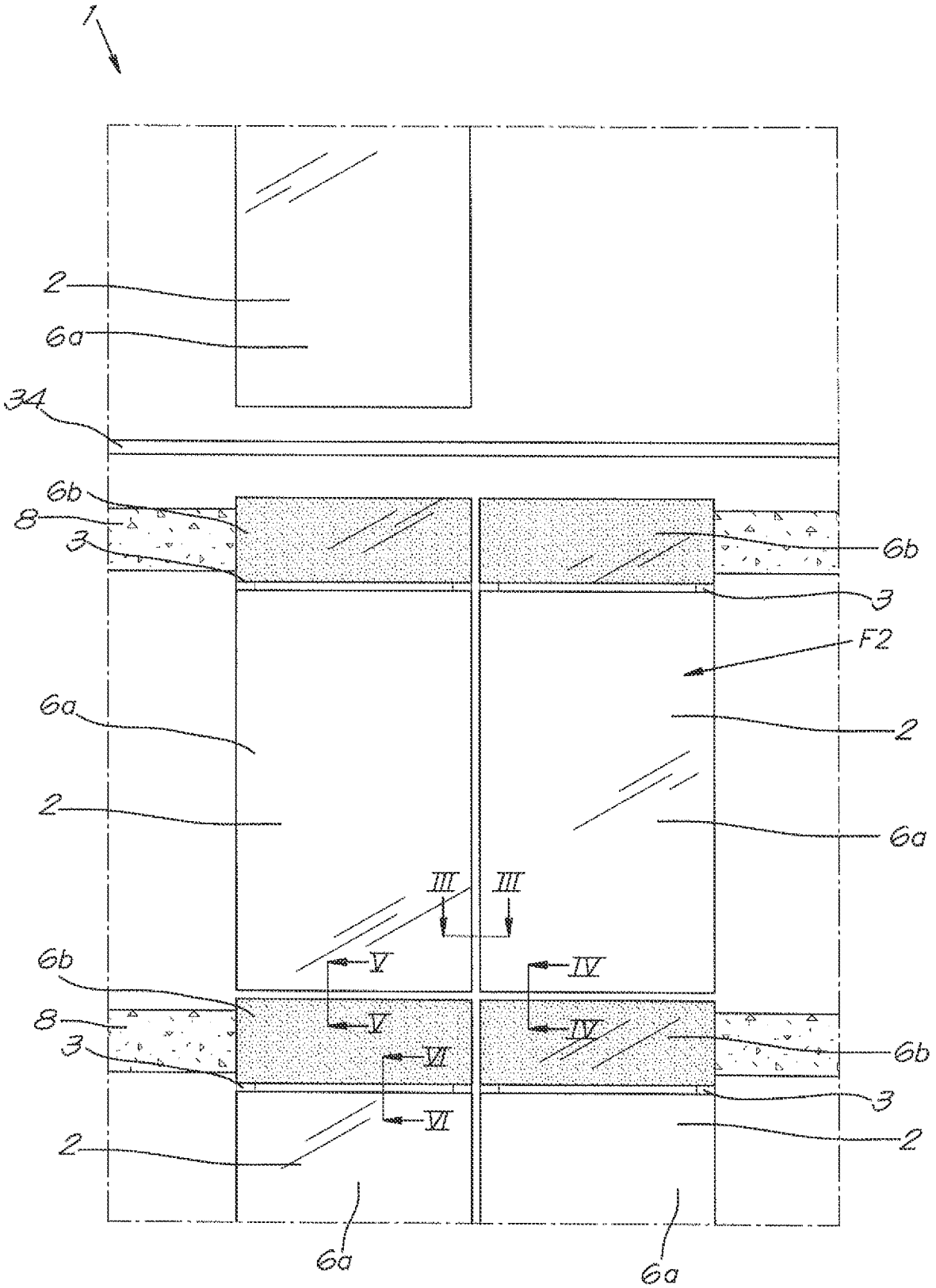
FIG. 1 schematically shows an external view of a curtain wall according to the invention being constructed with a partial cutaway.

The curtain wall 1 shown in FIG. 1 is a curtain wall of the modular type constructed from individual prefabricated rectangular wall elements 2 in the form of separate modules placed in rows next to and above one another to create a level wall, forming the supporting structure of the curtain wall 1.

Figure 2:
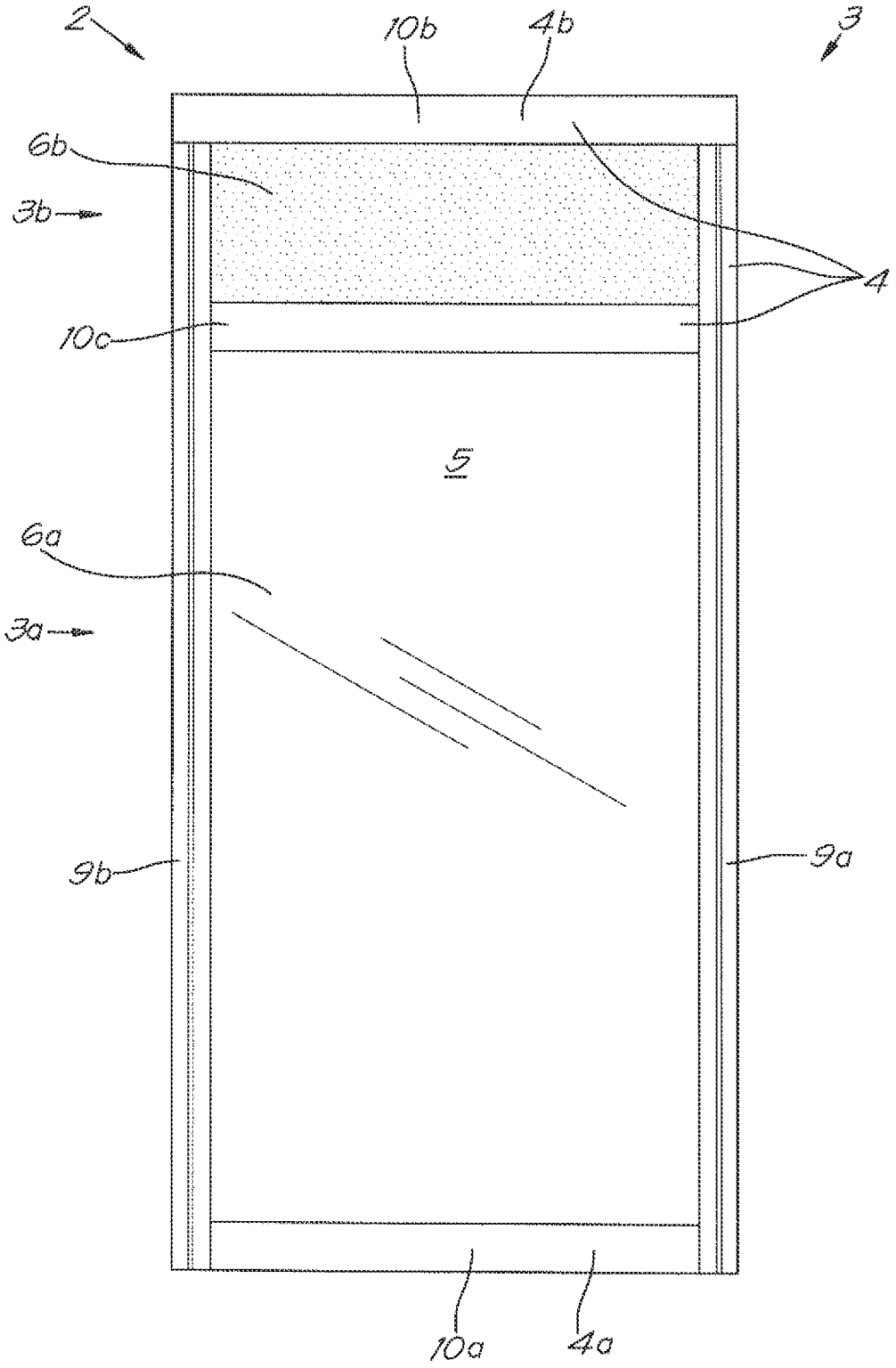
FIG. 2 shows an internal view of a wall element as indicated with F2 in FIG. 1.

As is apparent in FIG. 2 the wall elements 2 or modules are composed of a basic frame 3 of assembled one-piece profiles 4 on the inside 5 of the curtain wall 1 and of rectangular infill elements 6 on the outside 7 of the curtain wall 1 which almost entirely cover the basic frame 3, whereby the basic frame 3 is therefore hidden behind the infill elements 6 so that it appears as if the outside 7 of the curtain wall 1 consists entirely of infill elements in glass or the like.

The wall elements 2 are suspended on a basic structure at floor height 8, whereby a wall element 2 spans the height of a storey.

Preferably, the wall elements 2 are fitted with two infill elements, being a see-through infill element 6*a* at floor level and preferably a non-translucent or opaque infill element 6*b* to conceal the thickness of the floors 8.

In the example in the figures the infill elements 6 are formed by triple glazing although this is not essential.

Frame 3 is constructed from one-piece mullions 9 and one-piece transoms 10, whereby the transoms 10 have perpendicular ends and are connected with the mullions 9 using screws 11.

As illustrated in FIG. 3 the basic frame 3 contains two types of mullions 9 that fit inside each another telescopically, respectively a mullion 9*a* with an open U-shaped female coupling part 12 and a mullion 9*b* with a complementary open U-shaped male coupling part 13, whereby the two types of mullions 9*a* and 9*b* slide with their coupling parts telescopically inside each other and whereby these mullions 9*a* and 9*b*, with the exception of the coupling parts, are as good as symmetrical relative to a median plane 14.

The mullions 9*a* and 9*b* of adjacent wall elements 2 are coupled to each other as shown in FIG. 3 and thus form in their coupled state a composite rectangular beam-shaped basic profile 4, as it were, consisting of two predominantly symmetrical semi-profiles 9*a* and 9*b* for the mullions and 10*a* and 10*b* for the transoms 10.

In the example the male coupling part 13 is formed by two parallel legs 15 which grasp between parallel walls of the female part 12 and are sealed off using seals 16 and 17 on the free end of the legs 15.

These seals are preferably formed by co-extrusion of one or two materials, respectively a rubber or the like and a stiff material to form a stiff foot 16' and 17' which allows the seal to be slid in the lengthways direction into the appropriate detailing during assembly of the frame 3.

In the example of the figures, the basic frame 3 contains three transoms 10, featuring a lower transom 10*a*, an upper transom 10*b* and one or more intermediate transoms 10*c*, in this case just one intermediate transom 10*c*, whereby the lower transom 10*a* and the one or more intermediate transoms 10*c* are mounted between the mullions, while the upper transom 10*b* is mounted on the mullions 9.

Figure 5:
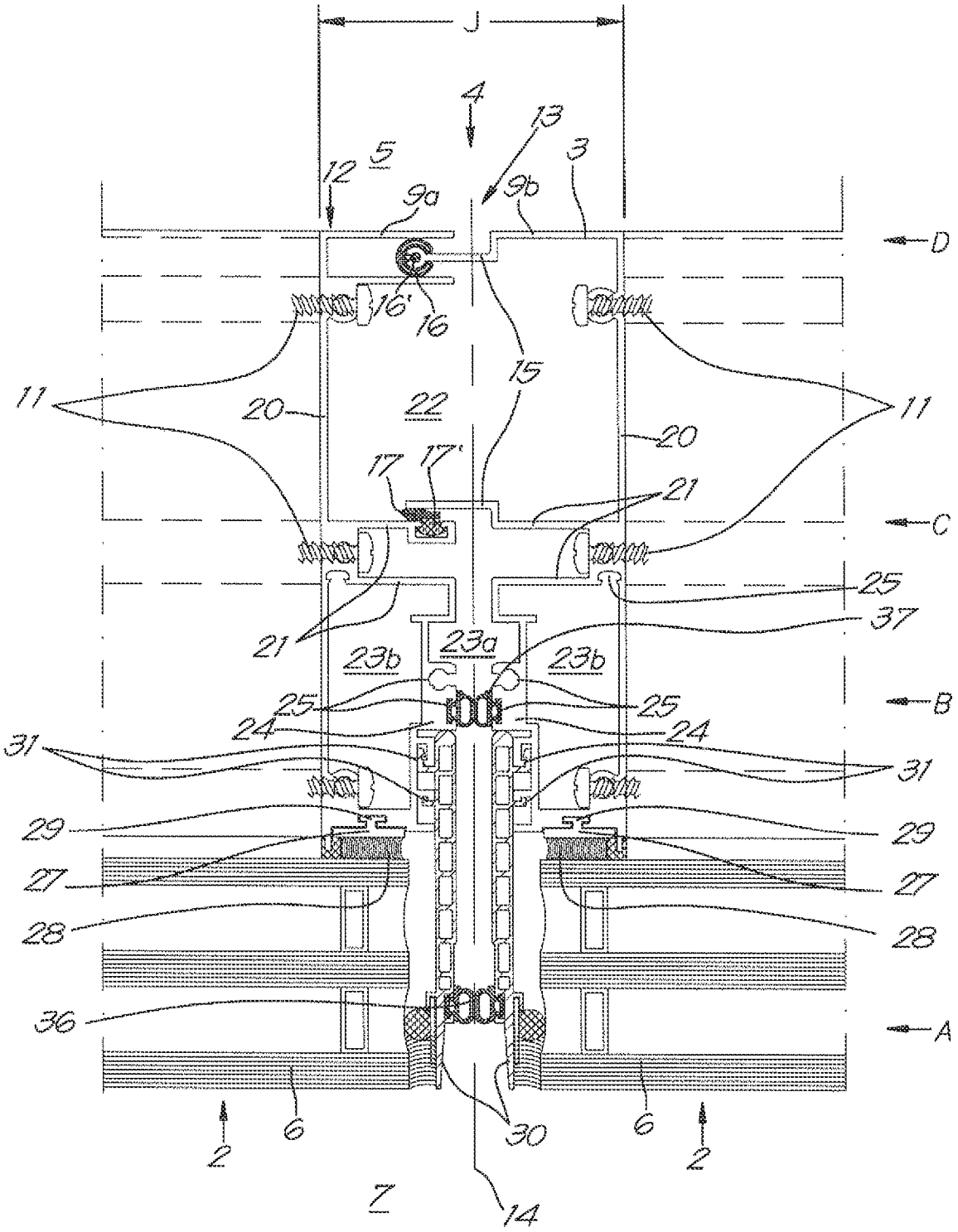
FIGS. 5 and 6 show cross-sections, respectively according to the lines V-V and VI-VI in FIG. 1.
Figure 4:
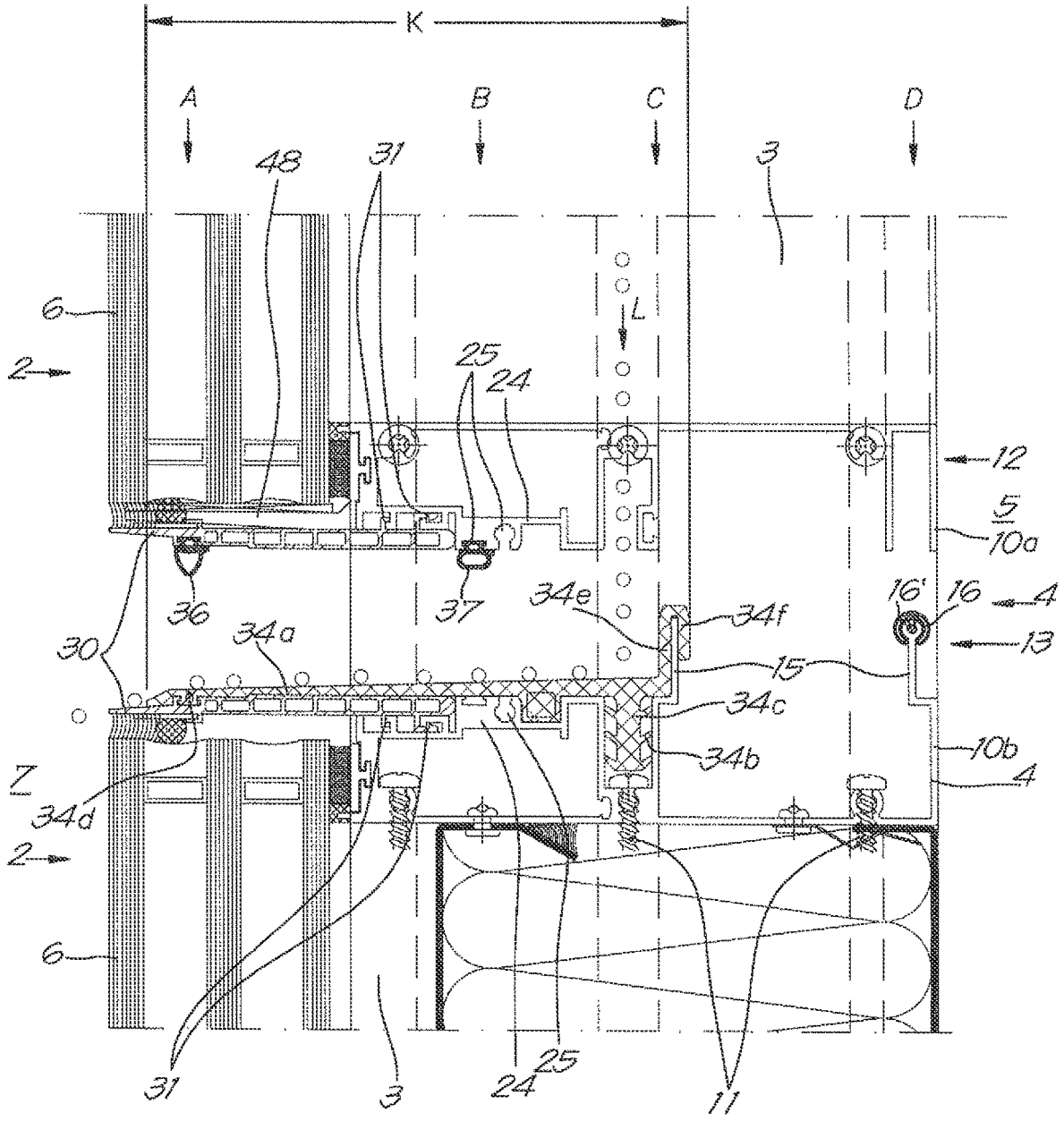
FIG. 4 shows a cross-section according to the line IV-IV in FIG. 1, yet in disassembled state.
Figure 5:
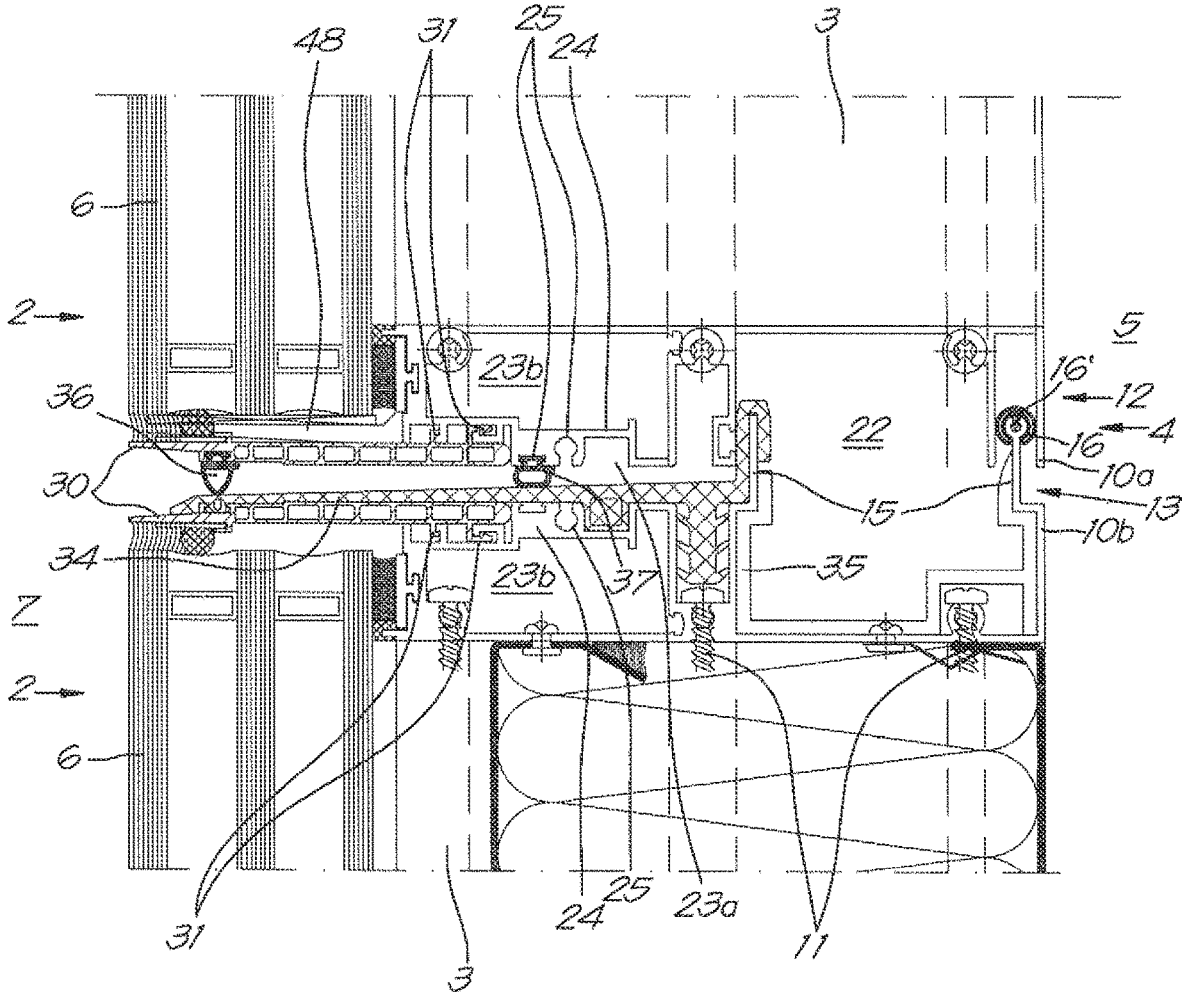

In terms of profiling the upper transom 10*a* and the lower transom 10*b* are identical to the profiles of the mullions 9*a* and 9*b* and fit together in the same telescopic manner as shown in the FIGS. 4 and 5, whereby the lower transom 10*a* features a downward facing female coupling part 12 and the upper transom 10*b* features an upward facing male coupling part 13 that, when assembled, extends into the female coupling part 12 of a higher wall element 2. Just as the mullions 9*a* and 9*b*, the transoms 10*a* and 10*b* unite to form a composite profile 4 that, in terms of shape, is predominantly in line with the aforementioned basic profile 4.

Figure 6:
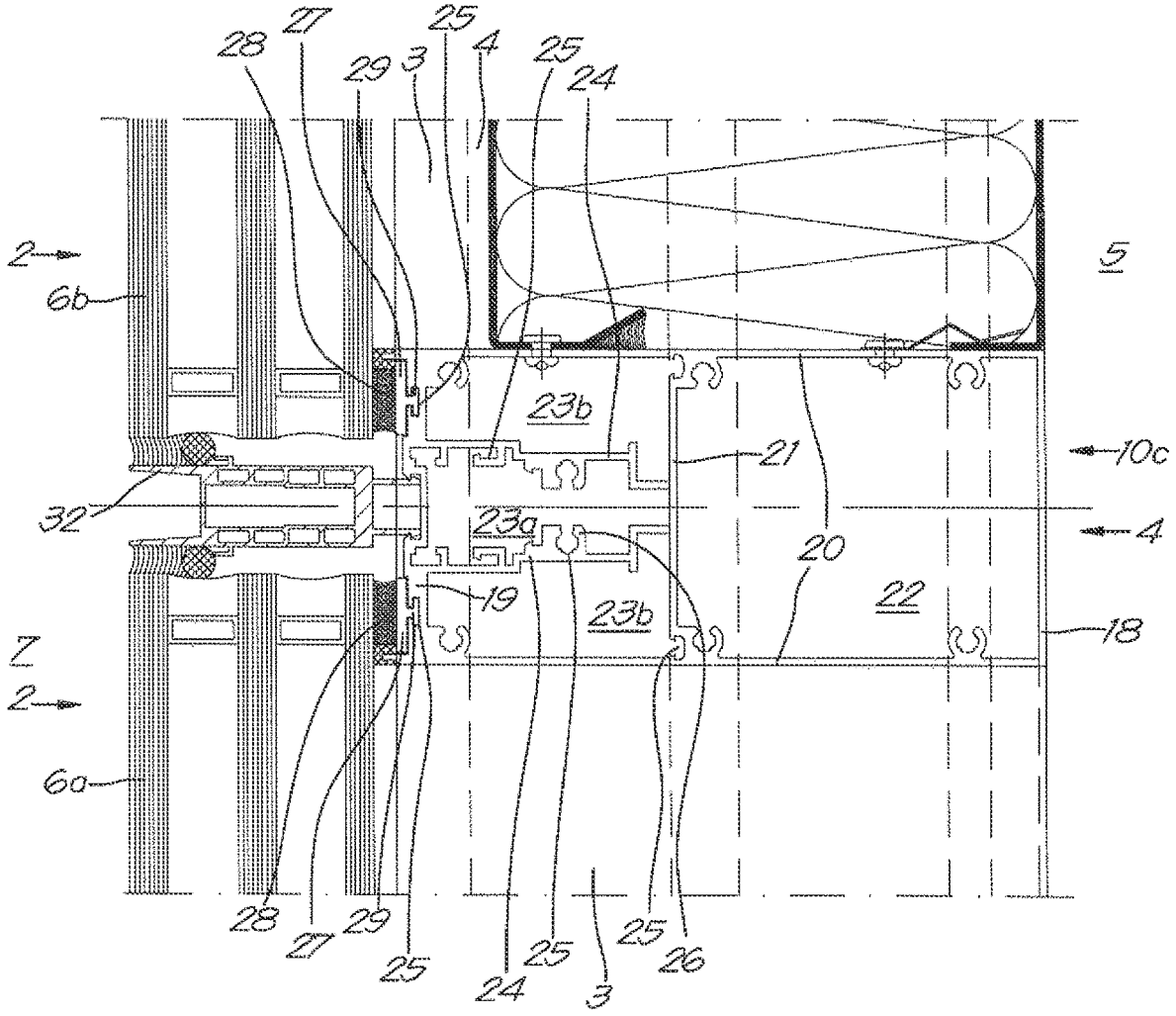
Figure 7:
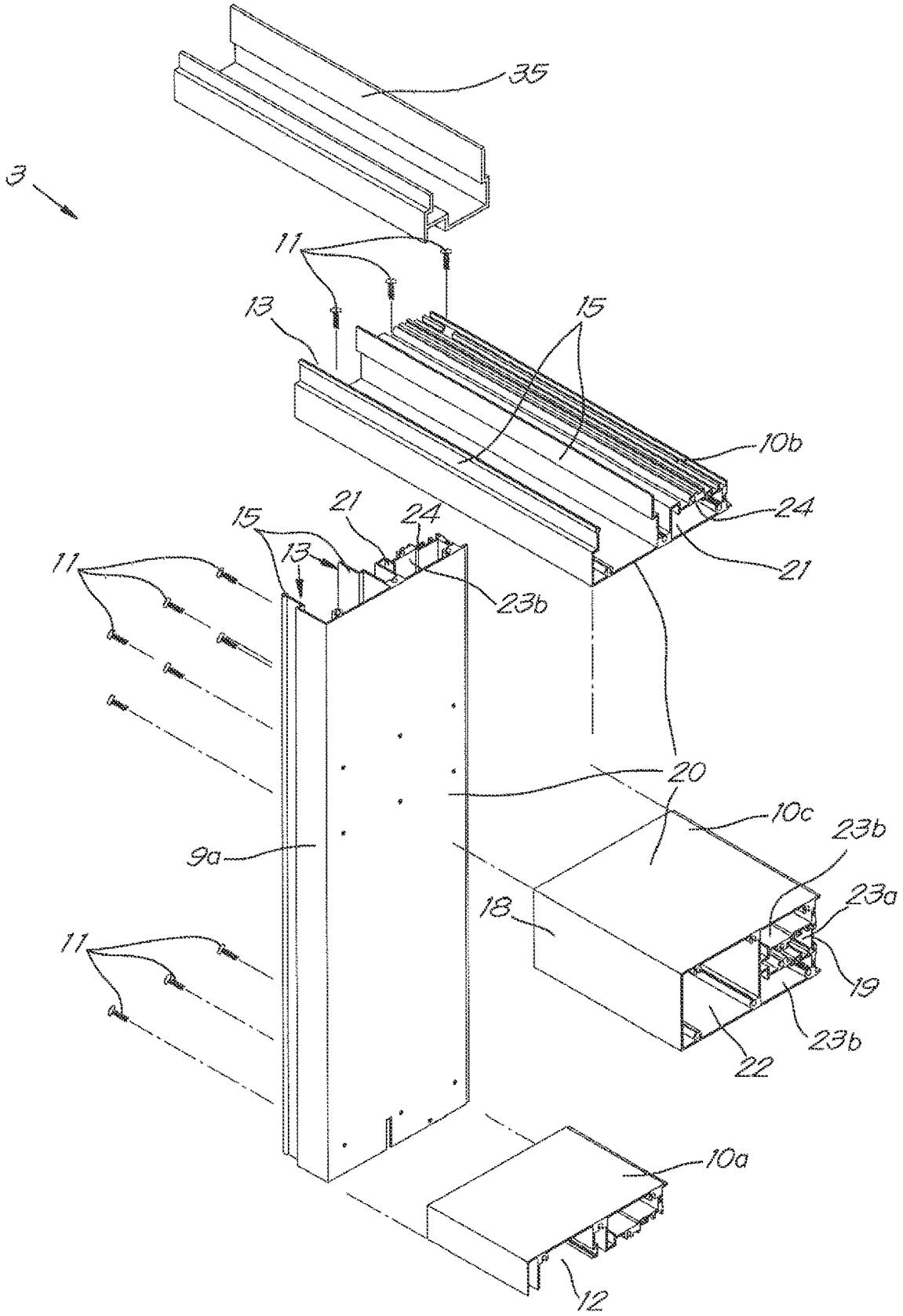
FIGS. 7 to 9 show in perspective and in disassembled state certain component parts of a wall element such as that of FIG. 2.

The intermediate transom 10*c* divides the frame 3 into two compartments 3*a* and 3*b* and has a cross-section as illustrated in FIG. 6 which in profiling terms, with the exception of the female and male coupling parts, is predominantly aligned with the composite basic profile 4.

The frame structure of the curtain wall 1 consequently appears to be composed exclusively of identical basic profiles 4, regardless of whether it is composed for the composite mullions 9*a* and 9*b* and transoms 10*a* and 10*b* or for the intermediate transoms 10*c*.

The basic profile 4 in FIG. 6 in line with an intermediate transom 10*c* is a rectangular tube profile with an inside wall 18 and an outside wall 19, i.e. an inside wall 18 facing the inside 5 of the curtain wall 1 and an outside wall 19 facing the outside 7 of the curtain wall 1 against which the infill elements 6 are attached, whose walls 18 and 19 are connected to each other by two parallel side walls 20.

The basic profile 4 is divided into two chambers using a partition 21 at a distance from the inside wall 18 and from the outside wall 19, respectively an inside chamber 22 on the inside 5 of the curtain wall 1 and an outside chamber 23 on the outside 7 of the curtain wall 1, whereby the outside chamber 23 is subdivided using two connecting walls 24 between the outside wall 19 and the partition 21 into three internal chambers, respectively into a middle chamber 23*a* and two internal side chambers 23*b* on each side of the middle chamber 23*a*.

As shown in FIGS. 4 and 5 the composite mullions 9 and transoms 10 substantially contain the same characteristics with the difference that the inside chamber 22 is now formed by the female and male coupling parts 12 and 13 which engage with each other and that the middle chamber 23*a* is now open and the partition 21 is realised with a double wall and divided into two parts.

The internal side chambers 23*b* are thus contained by 4 walls, namely by an outside wall 19, a side wall 20, a partition 21 and a connecting wall 24.

The connecting walls 24 of the internal side chambers 23*b* feature identical yet symmetrical detailing 25 on the sides facing each other for the attachment of seals or other components plus a protruding part 26.

Also, the outside wall 19 is fitted with detailing 25 at the level of the middle chamber 23*a* and, at the level of each internal side chamber 23*b*, with detailing 25 in the form of T-shaped recesses provided for the attachment of the infill elements 6 using aluminium slats 27 which are glued all the way around the inside of the infill elements 6 with structural silicone 28, for example structural silicone, whereby the slats 27 feature a T-shaped foot 29 which can be slid to fit into an aforementioned T-shaped recess. The slats 27 need to undergo an individual check to ensure that their surface treatment will not come loose when used in structural glazing.

Also, the partition 21 features detailing 25 on the inside of the internal side chamber 23*b* for assembly of seals or the like.

The transoms 10 and mullions 9 resemble semi-profiles 10*a* and 10*b*, respectively 9*a* and 9*b*, of the basic profile 4 featuring the same detailing 25.

Figure 8:
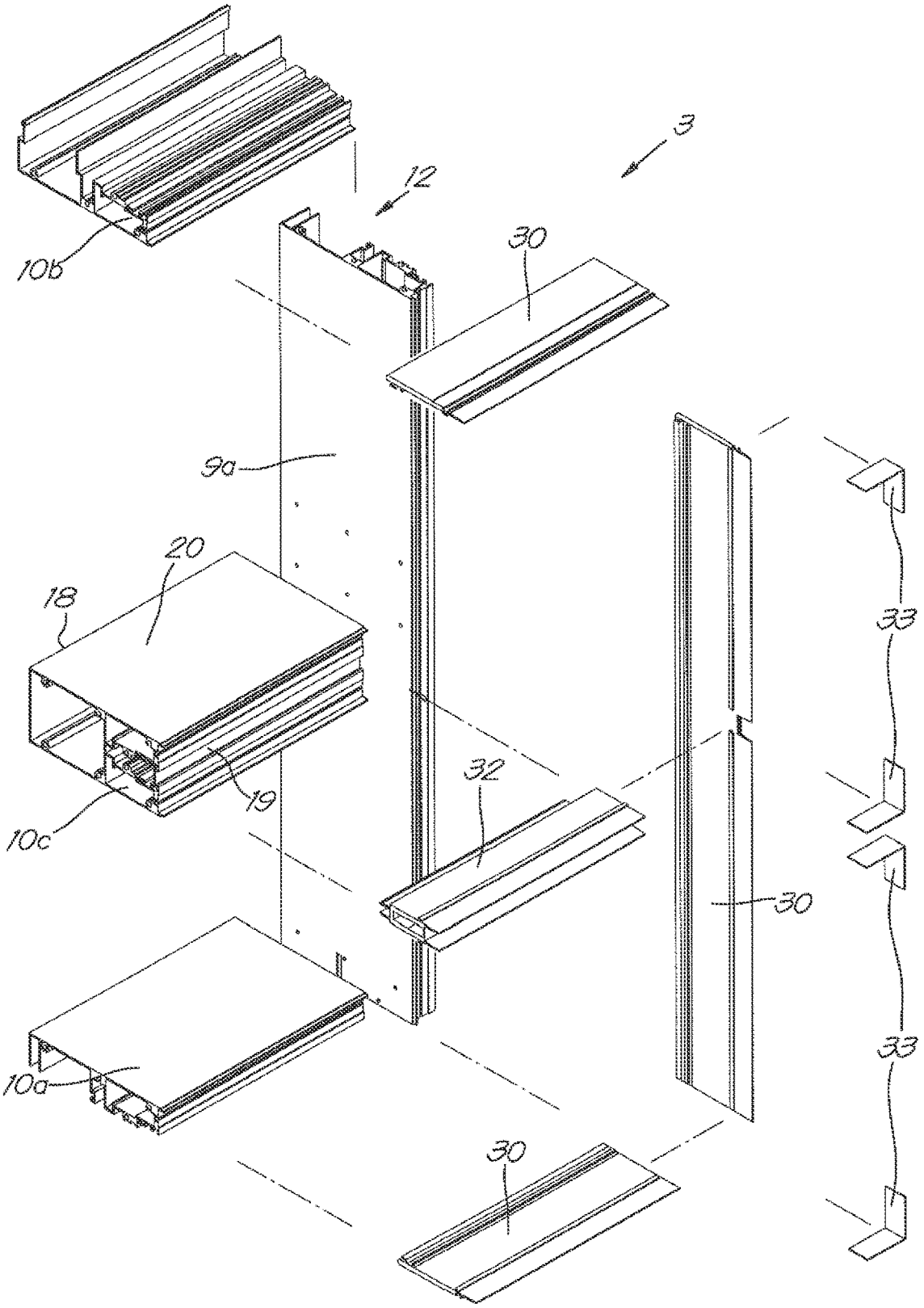

Around the perimeter of the infill element 6 insulation profiles 30 and 32 are fitted which, as shown in FIG. 8, are attached to mullions 9 and transoms 10 of the basic frame 3 using hooks 31 which, as shown in the FIGS. 3 and 4, are clicked into place in the specially-made detailing 25 on the connecting walls 24.

On the intermediate transom 10*c* an insulation profile 32 is attached as shown in FIG. 6, which connects the insulation profile 32 with the insulation profiles 30 of the mullions 9.

In the corners the insulation profiles 30 are joined together and the insulation profiles 30 of the mullions 10 are connected with the insulation profile 32 of the intermediate transom 10*c* using L-shaped corner connectors 33 as shown in FIG. 8 whose legs slide into the hollow insulation profiles 30 and 32.

The insulation profiles 30 and 32 extend from the frame 3 to the outside 7 of the curtain wall 1 over the thickness of the edges of the infill elements 6 and are sealed at their outward facing free ends in relation to the infill elements 6 using a silicone or other sealing kit.

As shown in FIG. 5, between two rows of connecting wall elements 2 a horizontal seal 34 is attached, which extends continuously in a horizontal direction over the breadth of the curtain wall 1 or a part of this wall and in doing so continues over the mullions 9 between neighbouring connecting wall elements 2, covering at least the corner connections between the mullions 9 and the transoms 10 of connecting wall elements 2.

This horizontal seal 34 is attached during construction of the curtain wall 1, as soon as a complete row of wall elements 2 or a part of such is constructed, on top of the row of wall elements 2 across the entire length of the row, after which assembly of a following row of wall elements 2 can begin as shown in FIG. 1 by clamping the horizontal seal 34 on the wall elements 2 below with the help of the profiling 34*b* and 34*d* without requiring other means of attachment such as screws or the like.

The horizontal seal 34 is a one-piece profile made of EPDM rubber or the like with a predominantly flat part 34*a* that rests on top of the row of wall elements 2 below and continuously covers the insulation profiles 30 of the wall elements 2 across the connecting perpendicular corner connections between the mullions and transoms of connecting wall elements 2 and this without making cuts or extra drilling and without any silicone.

This kind of EPDM rubber seal has the advantage of being a supple seal which can, for example, be rolled onto a roll and can then simply be rolled off this roll onto the wall elements 2 below and clamped together with the profilings 34*b* and 34*c* on the wall elements 2.

The length of the applied horizontal seals 34 are therefore required to be greater than the breadth J of the composite mullions 9*a*-9*b* as shown in FIG. 3 and is preferably such that several wall elements 2, preferably all wall elements 2, in a row of wall elements 2 can be bridged with this horizontal seal 34.

Should the length of a horizontal seal 34 be insufficient to cover the entire length of the row below, then use shall be made of several lengths of such a seal 34 connecting inside the breadth of a higher wall element 2 where there is no danger of a leak occurring at the side of this connection and where both extremities of the horizontal seal 34 are stuck together or vulcanised.

The top side of the flat part 34*a* slopes down towards the outside 7 of the curtain wall 1 to allow the good transit of water.

Preferably, the breadth K of the horizontal seal 34 is such that it stretches from the aforementioned most outward located leg 15 to or almost to the outside 7 of the curtain wall 1, so that, when in situ, this horizontal seal 34 acts as a sort of sill for the drainage of rainwater towards the outside 7 of the curtain wall 1.

Any infiltration water that might possibly infiltrate via the vertical joints will be carried away row by row via the underlying horizontal seal 34 towards the outside 7 of the curtain wall 1 as shown with indication L in FIG. 4. For the attachment of the horizontal seal 34 the flat part 34*a* on the underside is fitted with a downward facing profiling 34*b* which, as illustrated in FIG. 4, is fitted with barbs and which clamps tight into a groove contained by the walls or the double wall partition 21 of the underlying transom 10*b*.

The outward facing edge of the horizontal seal 34 is fitted with a first detailing 34*d* with which the seal 34 can be attached to the underlying insulation profile 30 and with a second detailing more towards the inside 5 of the curtain wall 1. In this way, the horizontal seal 34 is clamped onto an underlying wall element 2 in 3 places.

Furthermore, the horizontal seal 34 is made with an upstanding edge 34*e* of a height of for example 20 mm which extends into the female coupling part 12 of the lowest transom 10*a* of the wall elements 2 above and which clamps and seals between this female coupling part 12 and the upwardly extending leg 15 inside of the male coupling part 13 that is located closest to the outside 7 of the curtain wall 1.

The upstanding edge 34*e* keeps out any infiltration water and is fitted at the top with a hook-shaped bent end 34*f* that grasps the aforementioned upstanding leg 15.

At the level of the uppermost corners of connecting wall elements from an underlying row, the sideways connecting wall elements are connected together using a coupling profile 35 as shown in FIG. 5 in order to perfectly align the connecting wall element to ensure that the infill elements 6 on the outside 7 of the curtain wall 1 form a single surface.

Figure 9:
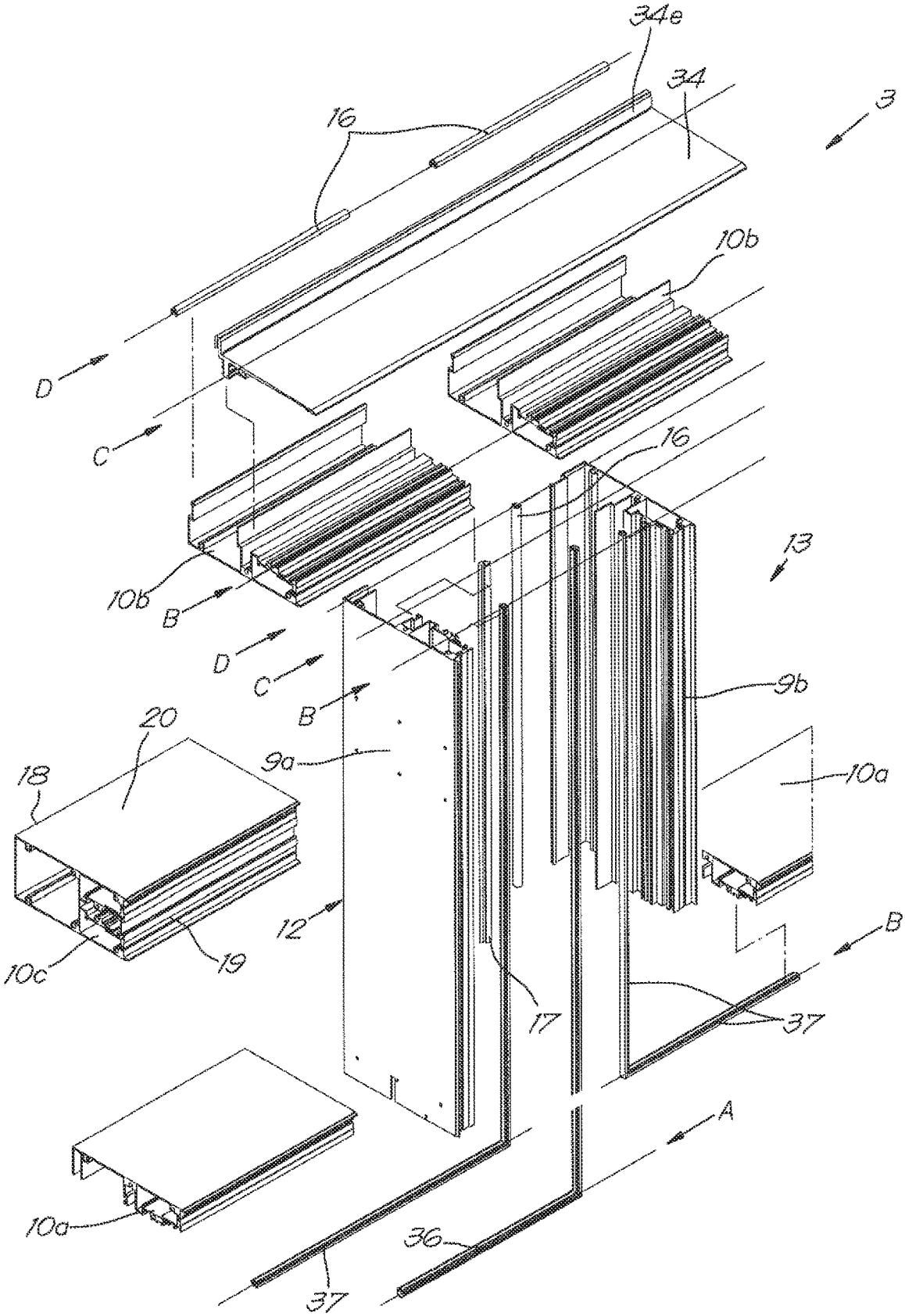

The wall elements 2 are sealed depth-wise along their perimeter from the outside 7 to the inside 5 of the curtain wall 1 on four levels A, B, C, D against each other as shown in the FIGS. 3, 4 and 9.

A first level A closest to the outside 7 of the curtain wall 1 is formed by first seals 36 which are attached respectively to the insulation profiles 30 of the mullions 9 and of the lowest transom 10*a*.

The second level B is formed by second seals 37 which are attached to the mullions 9 and to the lowest transom 10*a* of the basic frame 3 in a detailing 25 of the connecting walls 24.

The first and second seals 36 and 37 on the mullions seal each other, while the first and the second seals 36 and 37 seal the lowest transom 10*a* on the underlying horizontal seal 34.

The third level C is formed by the upstanding edge 34*e* of the horizontal seal 34 and by the aforementioned seals 17 between the female and male coupling parts 12 and 13.

The innermost fourth level is formed by the aforementioned seals 16 between the female and male coupling parts 12 and 13.

In this way a perfect water and airtight seal is achieved between the wall elements 2 and thanks to the continuous horizontal seal 34 also between the rows, whereby each row is isolated from another row in terms of water drainage and all the water from each row is transported via the horizontal seal 34 towards the outside 7 of the curtain wall 1.

Figure 10:
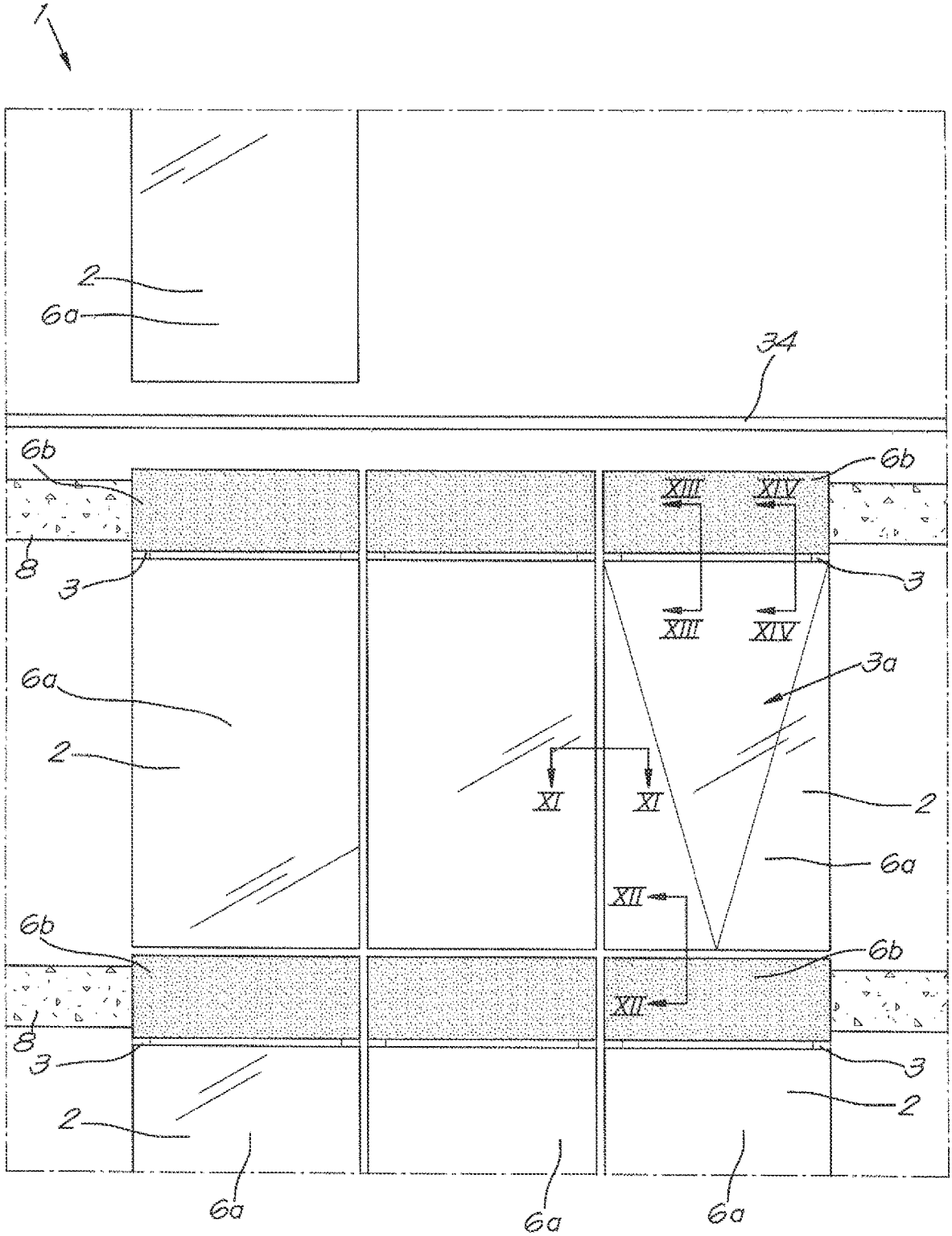
FIG. 10 shows a situation such as the one in FIG. 1 but whereby a wall element according to the invention is added with a wing that opens.

FIG. 10 shows a curtain wall 1 according to the invention whereby beside the wall elements 2 with fixed infill elements 6 a wall element 2 is now also fitted of which the one compartment 3*a* of the basic frame 3 is fitted with an outward-opening wing of a window while compartment 3*b* features a fixed infill element 6*a*.

The wing that opens is composed of a wing frame 3" and, attached to this wing frame 3", an infill element 6*a* that is fixed to the outside 7 of the wing frame 3" using structural silicone 28.

In terms of dimensions, the infill panel 6*a* of the wing is the same size as a fixed infill panel 6*a* and covers the wing frame 3" entirely or as good as entirely and is aligned with the other infill panels 6, so that no difference can be seen from the outside 7 of the curtain wall 1 between fixed infill panels 6 and infill panels of a wing.

When closed, the wing lies in a rebate 40 fitted along the perimeter of the compartment 3*a* of the wing in the basic frame 3, whereby this rebate 40 is formed by the fact that part of the internal chamber 23*b* of the mullions 9 and transoms 10 is missing or has been removed.

Figure 16:
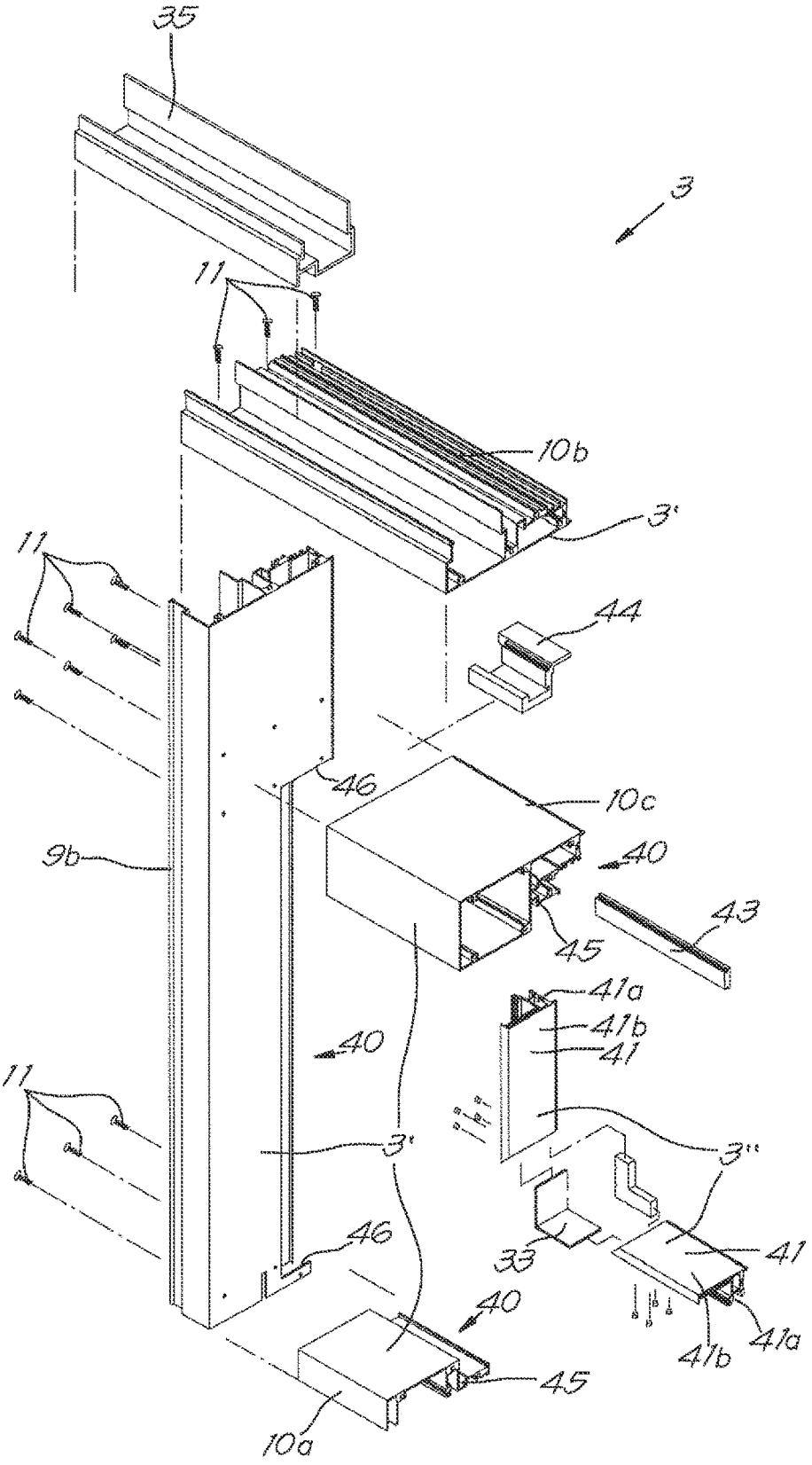
FIG. 16 shows the component parts of the frame of a wall element with a wing that opens.

As far as the mullions 9 are concerned the rebate 40 is formed by locally removing the mullions 9 in the basic frame 3 in line with the wing as shown in FIG. 16 whereby a part of the mullions 9 above and below the rebate is retained.

The rebate 40 is formed by opening the internal side chamber 23*b* by locally removing the side wall 20 of the internal side chamber 23*b* as far as the double walled partition 21, the outside wall 19 of the side chamber 23*b* and a part of the connecting wall 24 as far the protrusion 26.

The outward facing sides of the remaining partition 21 and of the protrusion 26 both form a stop for the wing frame 3", and do so with the intervention of a seal 38, respectively 39, to which the seal 38 is attached in the detailing 25 or the partition 21 and the seal 39 is attached to the wing frame 3".

Equally the transoms 10 on the top and bottom side of the winged compartment 3*a* feature an appropriate rebate 40 spanning their entire length.

With the fact that the rebate 40 stretches over the entire length, the transoms 10 made by profiles 10*a* and 10*c* can already allow for such a rebate 40 during manufacture or by using profiles with an internal chamber 23*b* which is opened across the entire length in the same way as for the rebates 40 in the mullions 9.

When ground in this way the mullions, on the one hand, and transoms extruded with the rebate, on the other, of the basic frame 3 thus form the external frame of the window as it were, so that no separate external frame is required to make a window that opens as is the case in traditionally known curtain walls. The invention lies in the fact that by applying the grinding technique to the mullions—where required in a wall compartment 3*a* featuring a wing that opens—, in the adjoining compartment or in the adjoining compartments of the same wall module and featuring a fixed infill element, no additional frame is required around these fixed infill elements in order to be able to place these in the basic frame 3, contrary to all existing systems.

The wing frame 3" of the wing is formed by profiles 41 which are predominantly L-shaped with a leg 41*a* and a leg 41*b*, this wing frame 3" with its outward facing side facing the outer face 7 of the curtain wall 1 with one leg 41*a* using an aforementioned aluminium slat 27 all around being glued against the inside of the infill element that opens 6*a* using a structural silicone 28 and with the other leg 41*b* facing in a perpendicular direction to this internal side.

The seal 39 and a shortened insulation profile 30" are attached to the leg 41*a*.

The rebate 40 is measured with ample room for traditional hardware 42, for example in the form of friction hinges.

For the intermediate transom 10*c* with rebate 40 in line with the protrusions 26 of the remaining connecting walls 24 an extra insulation slat 43 is attached as shown in the FIGS. 13 and 16.

Figure 15:
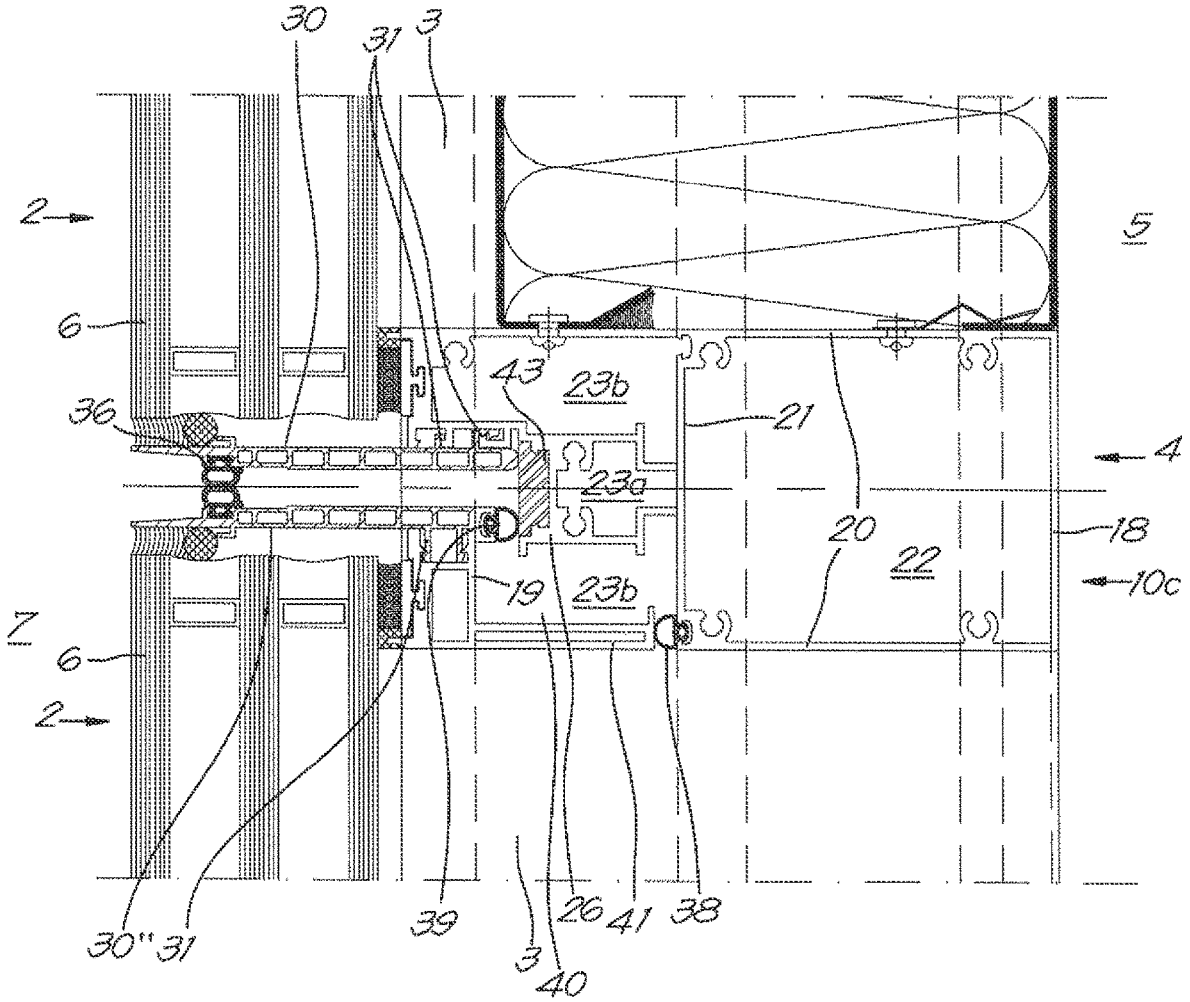
FIG. 15 shows a cross-section according to line XV-XV in FIG. 14.
Figure 14:
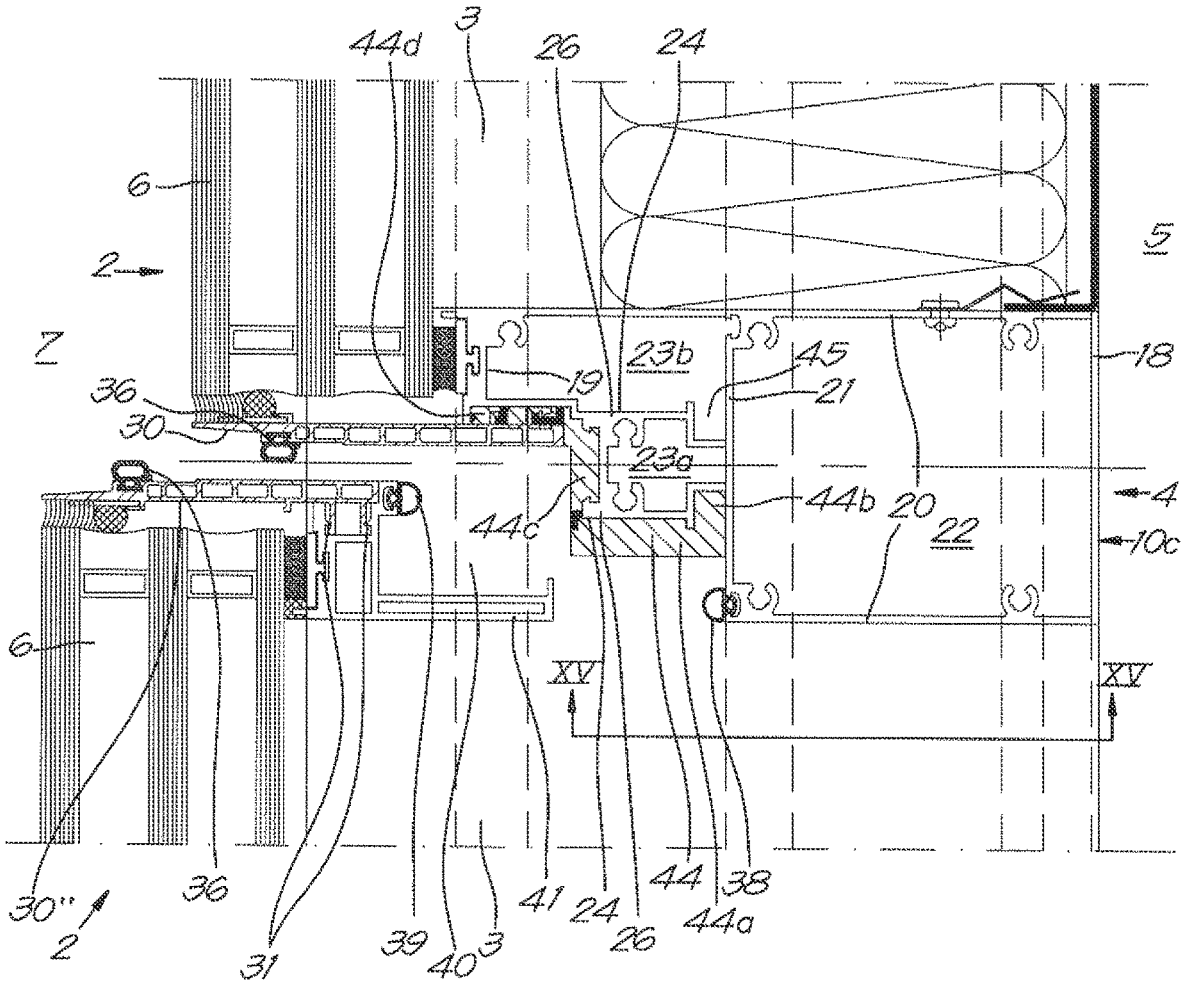
Figure 15:
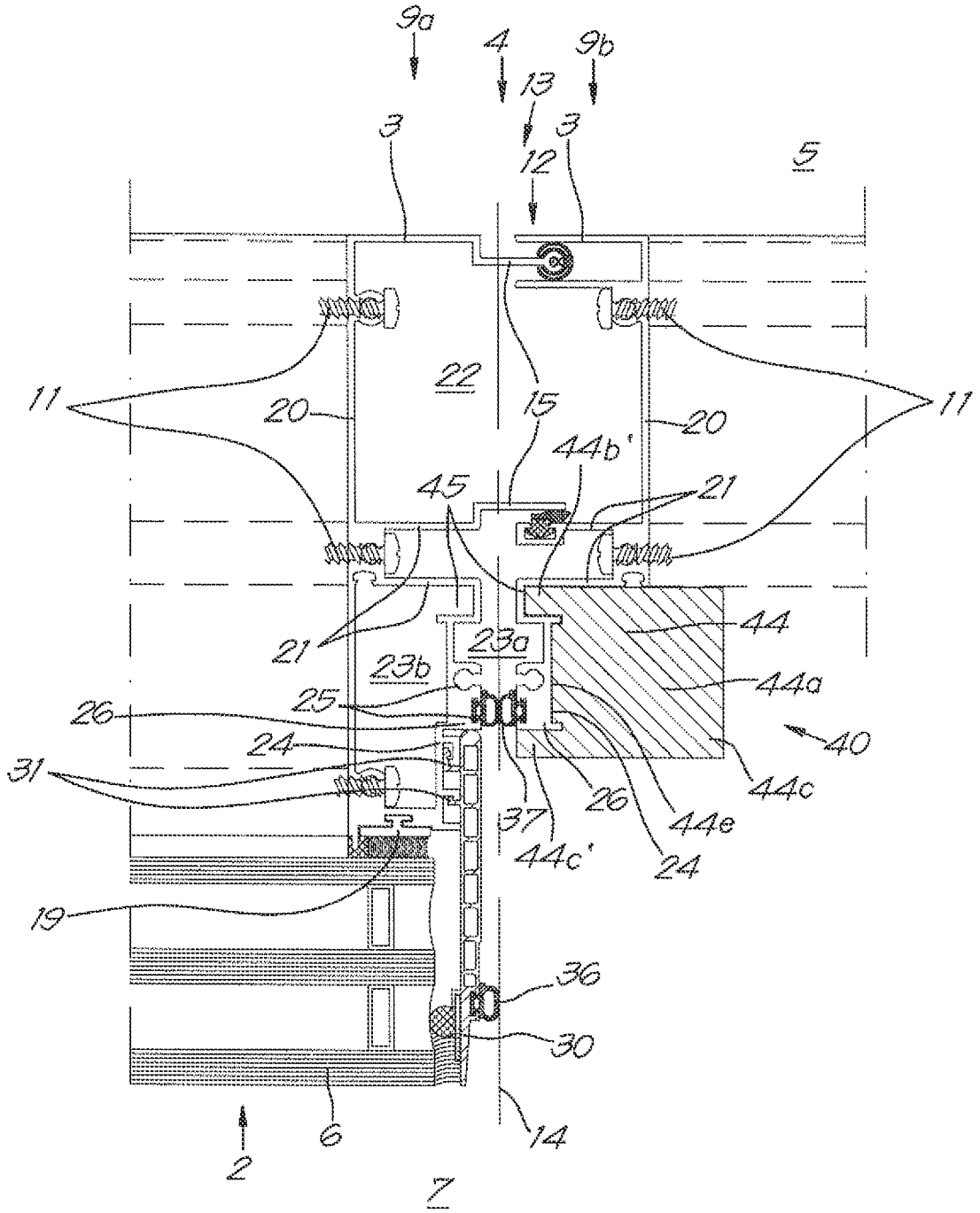
Figure 17:
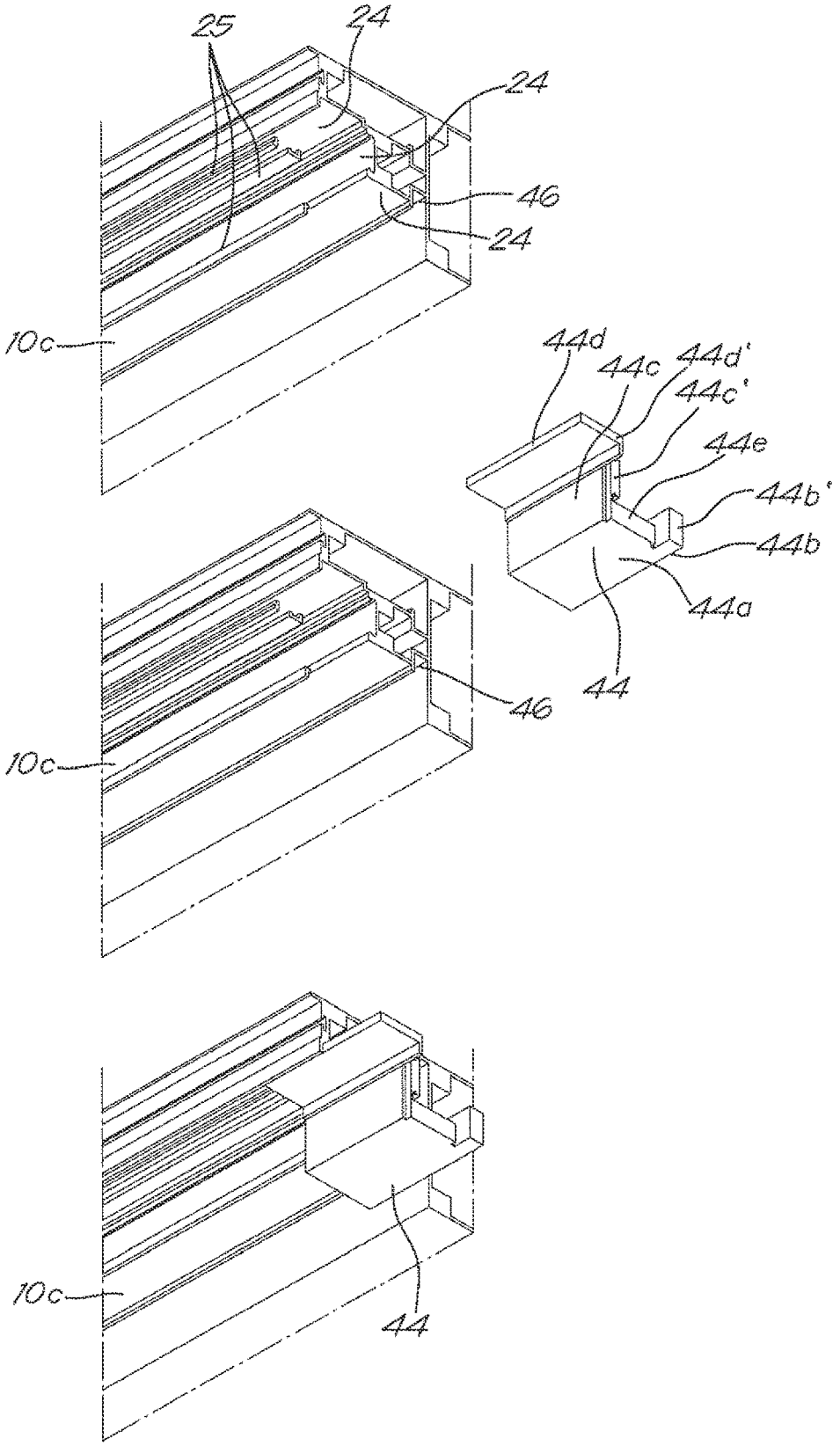
FIGS. 17 and 18 show the way to assemble the component indicated in FIG. 16 with F17.
Figure 18:
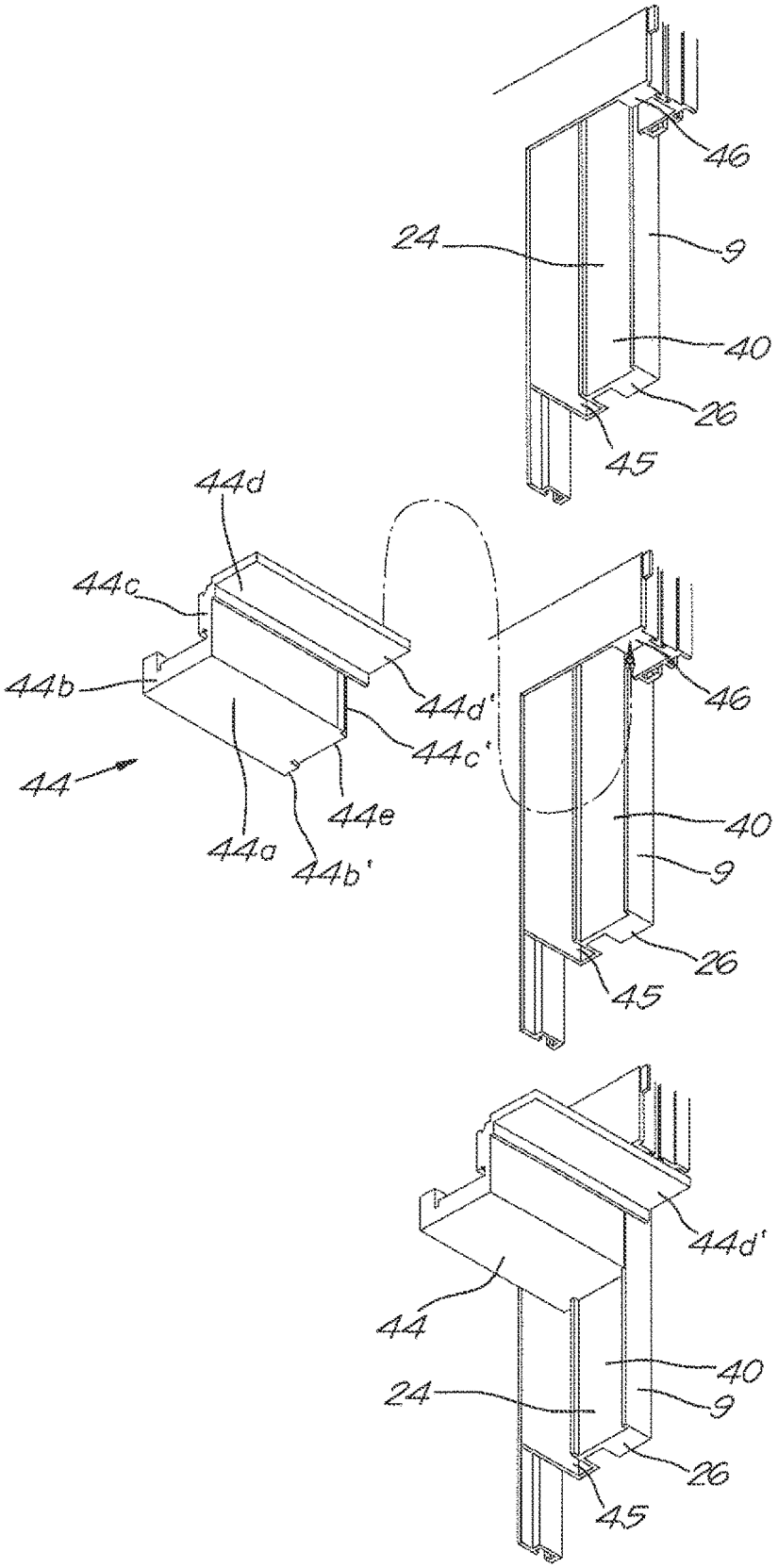

In the corners of the basic frame 3 a sealing corner piece 44 made of rubber, plastic or other sealing material is fitted against the inside of the rebate 40 and this is shown in the cross-sections of the FIGS. 14 and 15 and of which the installation is clarified using the FIGS. 16 to 18.

The corner pieces 40 are intended to perfectly seal the perpendicular corner connections between mullions 9 and transoms 10. After all, wind and rain penetrating the rebate between the basic frame 3 and the wing frame 3" must be stopped from entering the inside 5 of the curtain wall 1 via this corner connection.

The corner piece 44 shown in the figures is formed and sized in such a way that it attaches level with the rebate 40 in the intermediate transom 10*c* against the underside of the remaining connecting walls 24 and against the outside of the remaining protrusions 26 as shown in FIG. 14 and in FIG. 17 at the bottom.

As shown in FIG. 17 certain detailing 25 can therefore be removed in the corners across a particular length M by grinding or the like in order to obtain flat surfaces against which the corner piece 44 can be properly attached without the corner piece 44 needing to be made in a complex shape.

The length M across which the detailing 25 is removed can be chosen in such a way that when tightening the transom 10 against a connecting mullion 9 during assembly, the corner piece 44 is clamped between the remaining part of the overlying detailing 25 of the transom 10 and the connecting mullion 9.

As far as the corner pieces 44 in the corners of the intermediate transom 10*c* are concerned, the corner piece 44 in vertical cross-section is predominantly U-shaped with a back 44*a* and a short leg 44*b* and a long leg 44*c* and, on the free edge of the long leg 44*c* an outward stretching lip 44*d* that is perpendicular to this leg 44*c* and which adjoins a connecting wall 24 of a connecting side chamber 23*b*.

The short leg 44*b* therefore sits tightly in an upward-reaching groove 46 of a connecting wall 24 of the intermediate transom 10*c* of the fixed basic frame 3.

In this same way, in the corners of the lowest part transom 10*a* an analogue corner piece 44 is attached with the short leg 44*b* fitting into a corresponding downward-facing groove 45 of this part transom 10*a* on the basic frame 3.

In the horizontal cross-section of FIG. 15 and in FIG. 18 at the bottom it is possible to see that the corner piece 44 with a side edge 44*e* of the back 44*a* connects against the remaining part of the connecting wall 24 of the rebate 40.

The short leg 44*b* is extended sideways past the edge 44*e* of the back 44*a* and sits sideways with this extended part 44*b*' contained sideways in the groove 45 of a mullion 9.

The long leg 44*c* is also extended sideways and uses this extended part 44*c*' to grip across the protrusion 26 of the remaining connecting wall 24.

Also, the lip 44*d* is extended with a part 44*d*' beyond the edge 44*e* into the rebate 40 of the connecting mullion 9, thus buffed up against the cut edges 46 which limit the rebate 40 in the mullions on the top and bottom.

The corner pieces 44 are preferably glued into the fixed basic frame 3.

It is clear that a corner piece 44 for connection to the left-hand mullion 9 is the mirror image of the corner piece 44 of the figures for connection to the right-hand mullion 9.

It is clear that the corner pieces for the lowest transom 10*a* must vary somewhat from the corner piece 44 of the figures.

As the corner pieces 44 are made of rubber or another supple or semi-supple sealing material, these corner pieces 44 can cope with differential settings and the potential warping or distortion of the basic frame 3 without harming the water and airtight function and are able to do this without the use of any silicone or other kit material.

The corner pieces 44 are attached during the wall builder's production process in the factory and consequently under perfect quality control. As such, for example, the corner pieces are slid onto the ends of the transoms during production before the transoms are attached between the mullions 9 and are screwed tightly in-between.

When the wing is opened the corner pieces 44 become visible, but this causes no problem.

A curtain wall 1 system according to the invention is particularly well-suited to the prefabrication of wall elements 2, be these fixed wall elements with fixed infill elements 6 or wall elements with a wing that opens, on an automated production line under working conditions that can be accurately controlled, therefore guaranteeing a perfect finish.

Figure 19A:
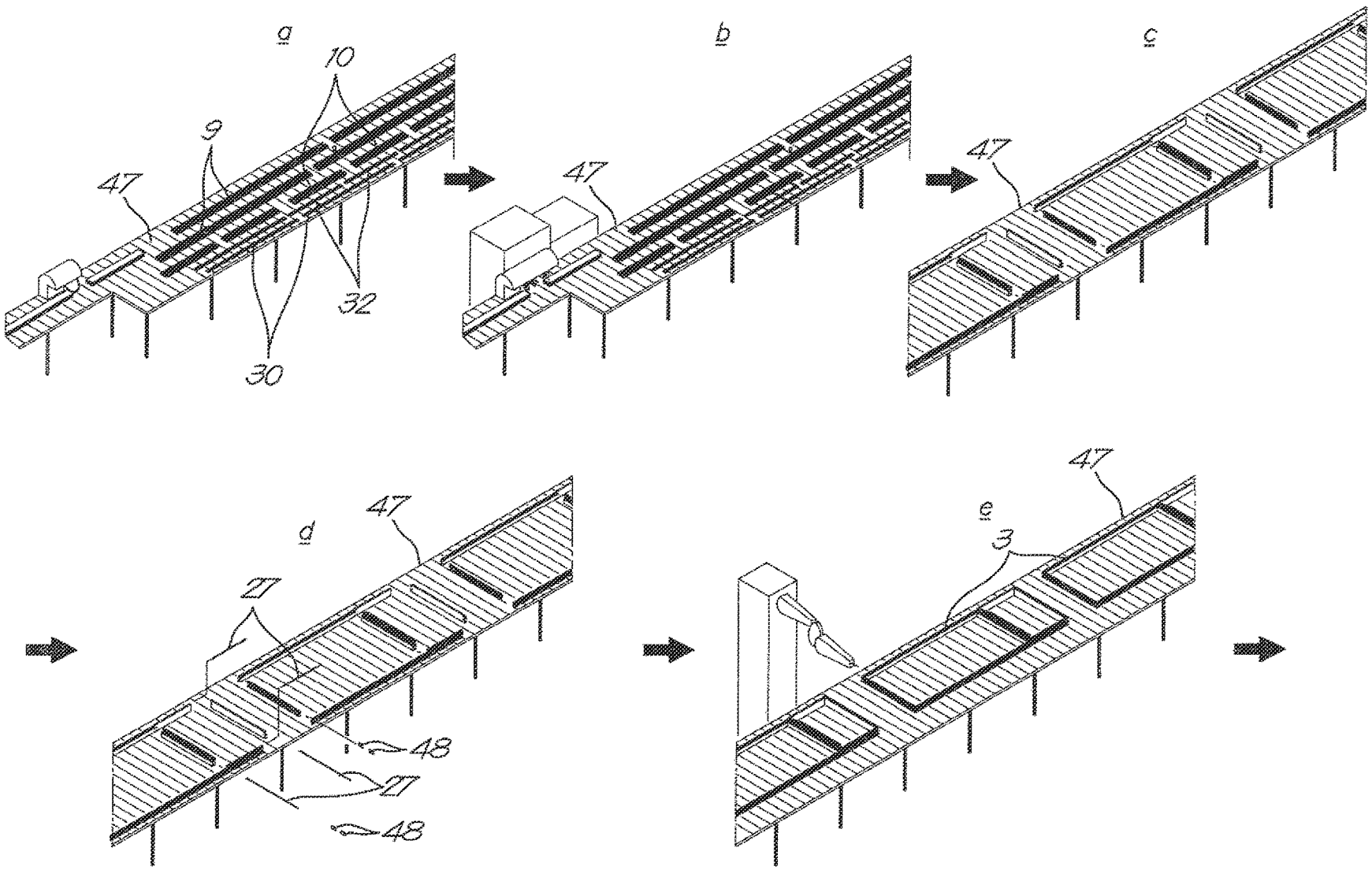
FIGS. 19A and 19B show a production line for the manufacture of wall elements according to the invention.
Figure 19B:
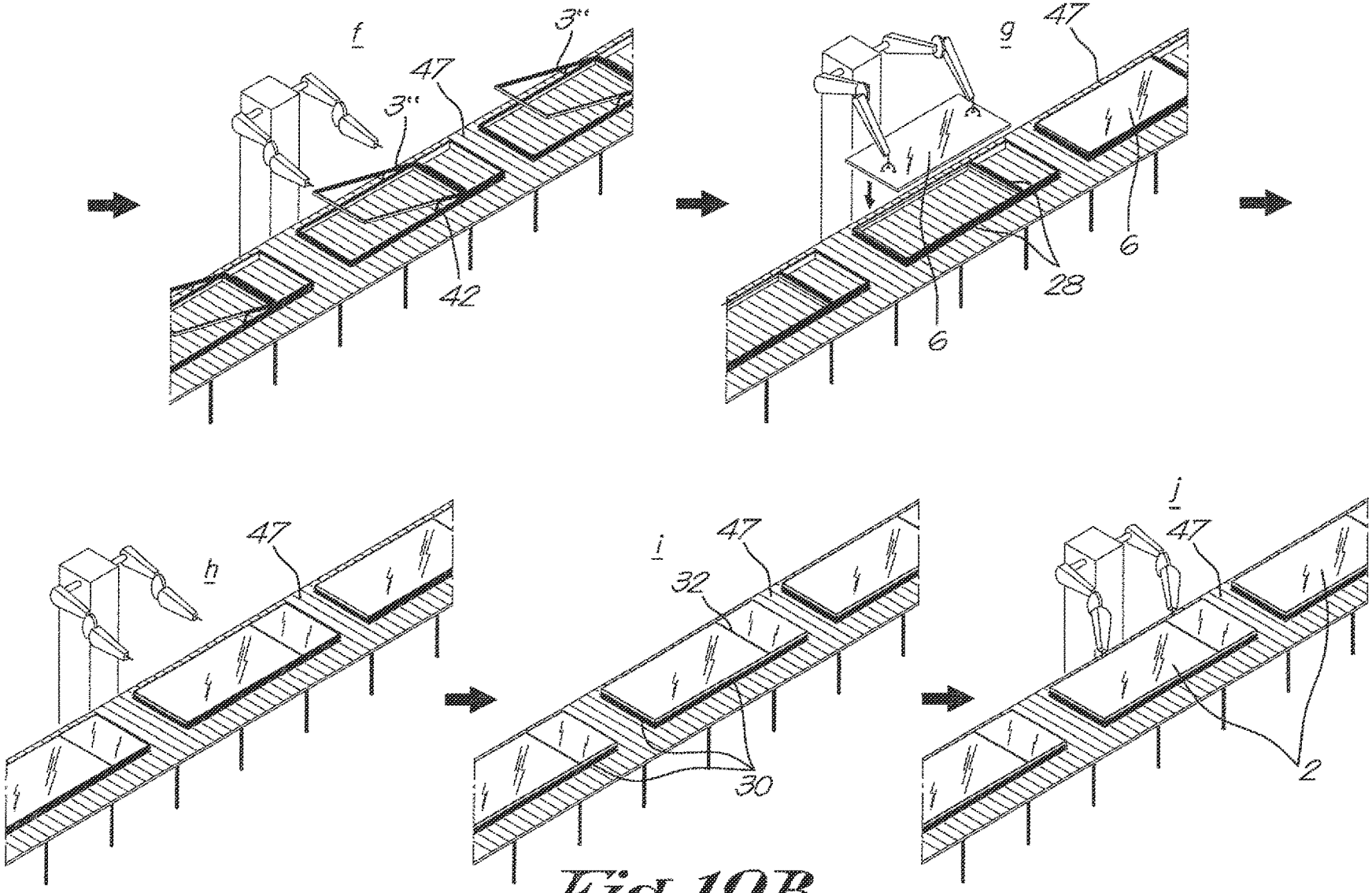

Such a production line is shown in a diagram in the FIGS. 19A and 19B in which use is made of a production line 47.

The production of the glazed wall elements 2 is carried out in the ten consecutive steps a through j as shown in FIG. 19:

a/ sawing all the profiles of the mullions 9 and transoms 10 and the insulation profiles 30 and 32 to the right length;

b/ machining, and if necessary grinding, the profiles using an automated machining device to create a rebate 40;

c/ positioning the profiles on the production line 47 with the inside of the mullions 9 and transoms 10 facing downwards in a position relative to the frame 3 under fabrication;

d/ sliding in the aluminium slats 27 to allow structural gluing of the infill elements 6 and the attachment of the glass supports 48;

e/ assembling the frames 3 by placing the screws 11 which connect the mullions 9 with the transoms 10 and installing all rubber seals 16, 17, 36, 37, 38, 39 and corner pieces 44;

f/ placing the wing frames 3" for the wings that open and for the required hardware 42 in the compartments in which a wing that opens is anticipated;

g/ installing the infill elements 6;

h/ applying the structural silicone 28;

i/ placing and securing the insulation profiles 30 and 32 for the thermal break;

j/ sealing the insulation profiles 30 and 32 along the edges of the infill elements 6 with the help of a silicone or other sealing kit.

It should be noted that throughout the entire production process the frames remain flat on the production line and consequently no time-consuming manipulation is required to turn the frames over, something that saves significant amounts of time.

It should also be noted that the prefabricated wall elements 2 are already fitted with all seals during 30 production in a controlled environment, with the exception of the horizontal seal 34 which is only attached during assembly in the curtain wall 1 in a row of in situ wall elements 2 before a following row wall elements is installed.

Figure 20:
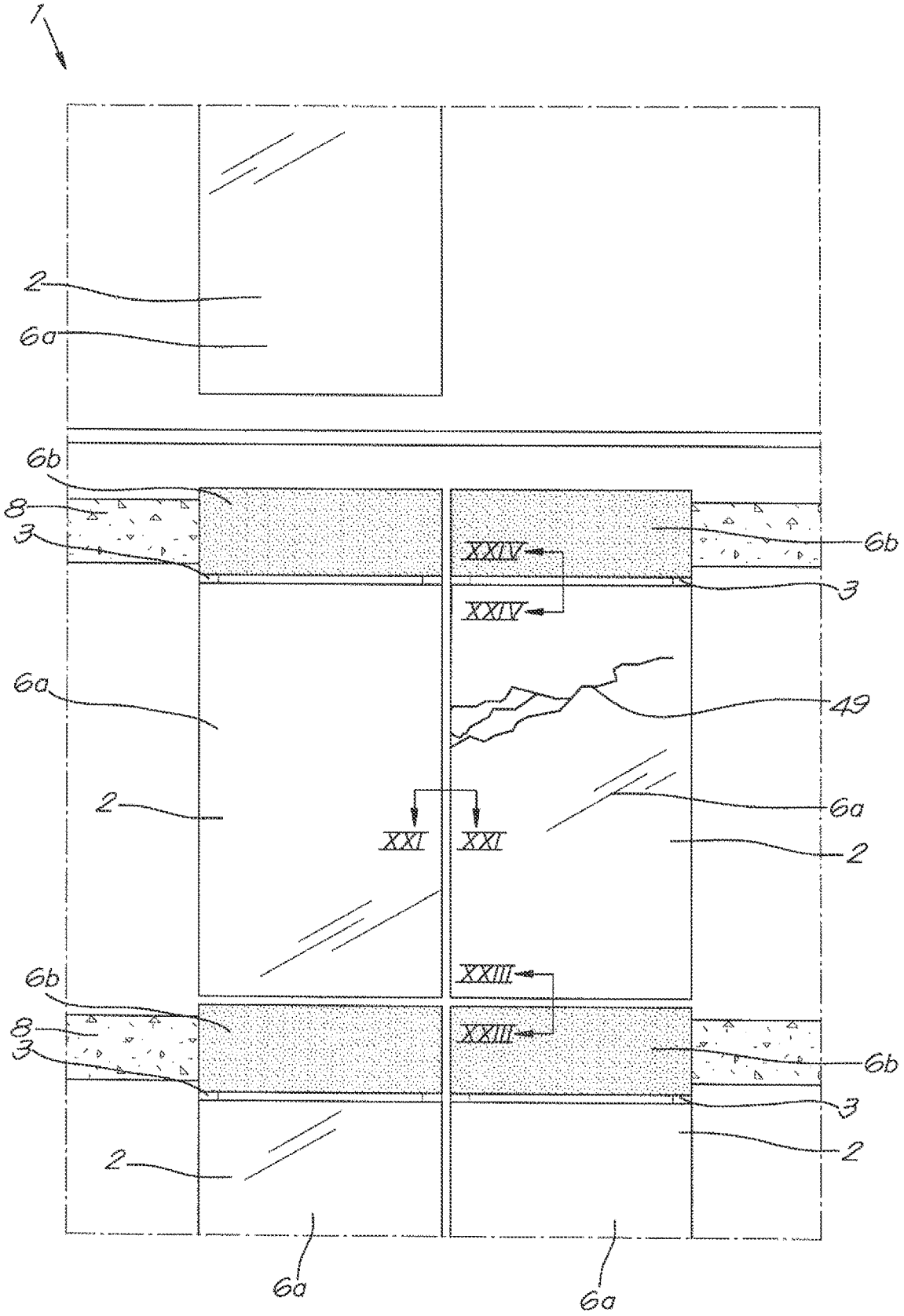
FIG. 20 shows a situation such as the one in FIG. 12 but whereby one wall element displays a cracked or damaged infill element that requires replacement.

Furthermore, the system of a curtain wall 1 according to the invention is highly suitable for the replacement of a fixed infill element 6*a*, for example due to damage or a crack 49 in the infill element 6*a* in a compartment 3*a* as shown in FIG. 20 or for whatever other reason.

Figure 11:
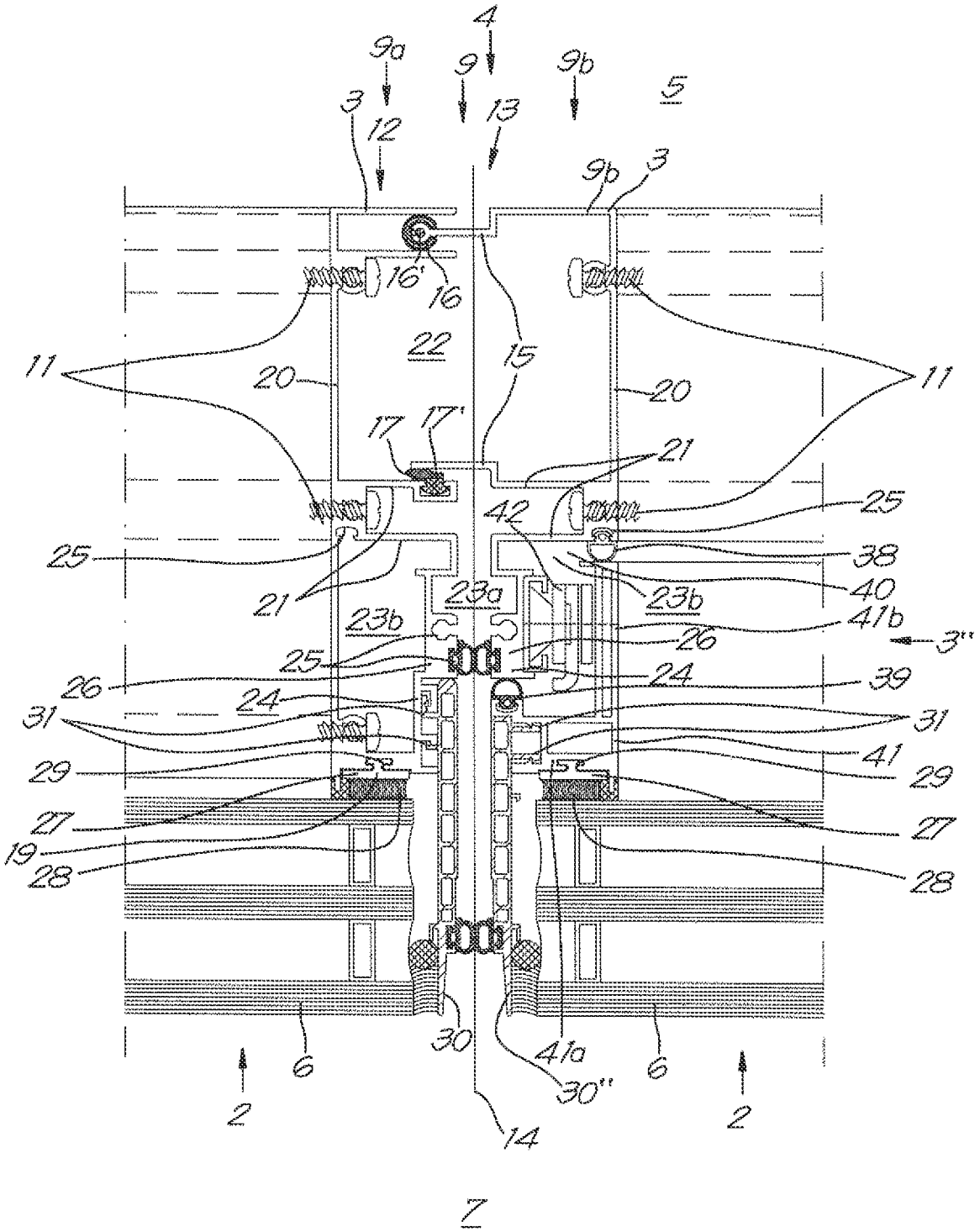
Figure 12:
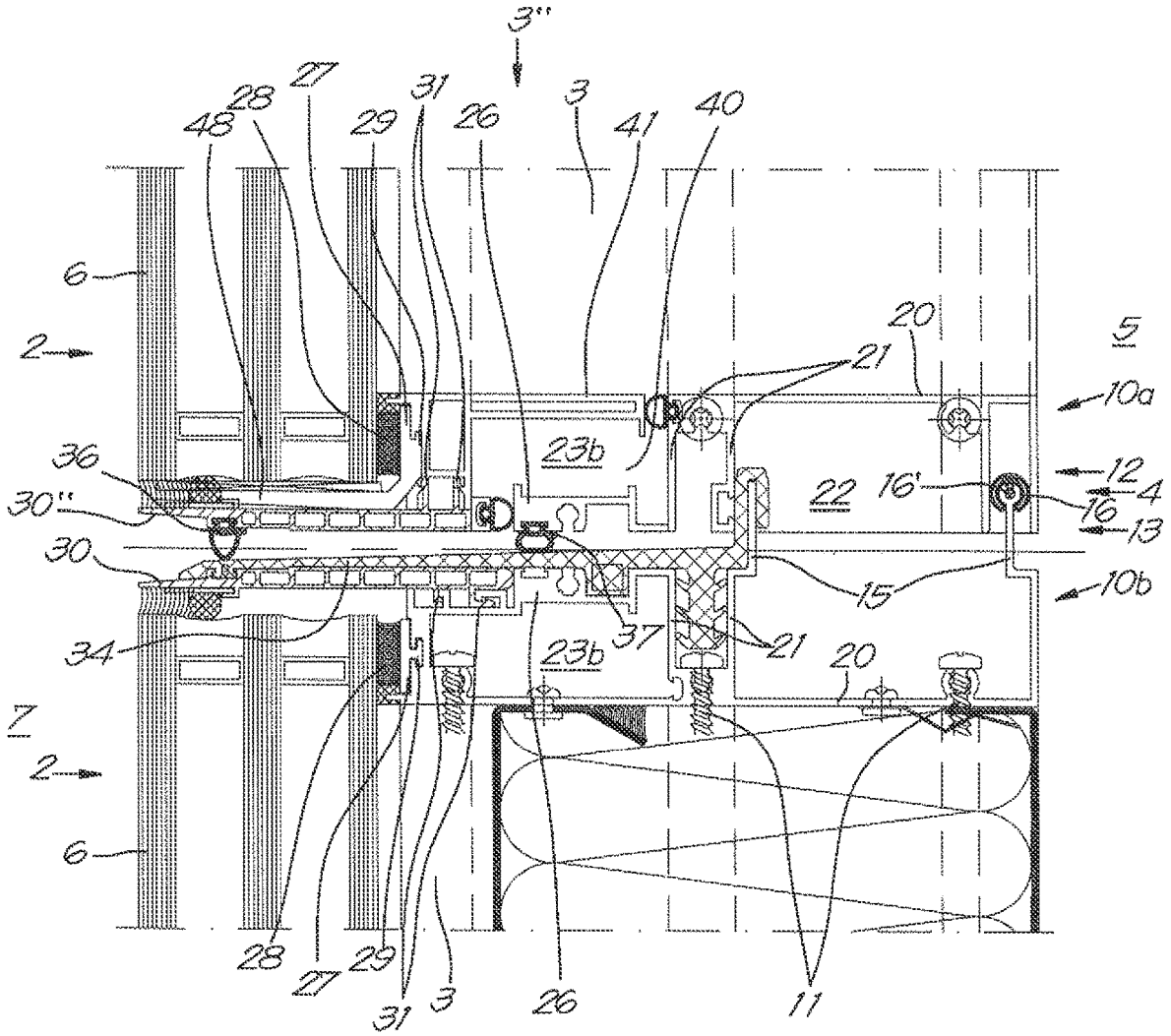
Figure 22:
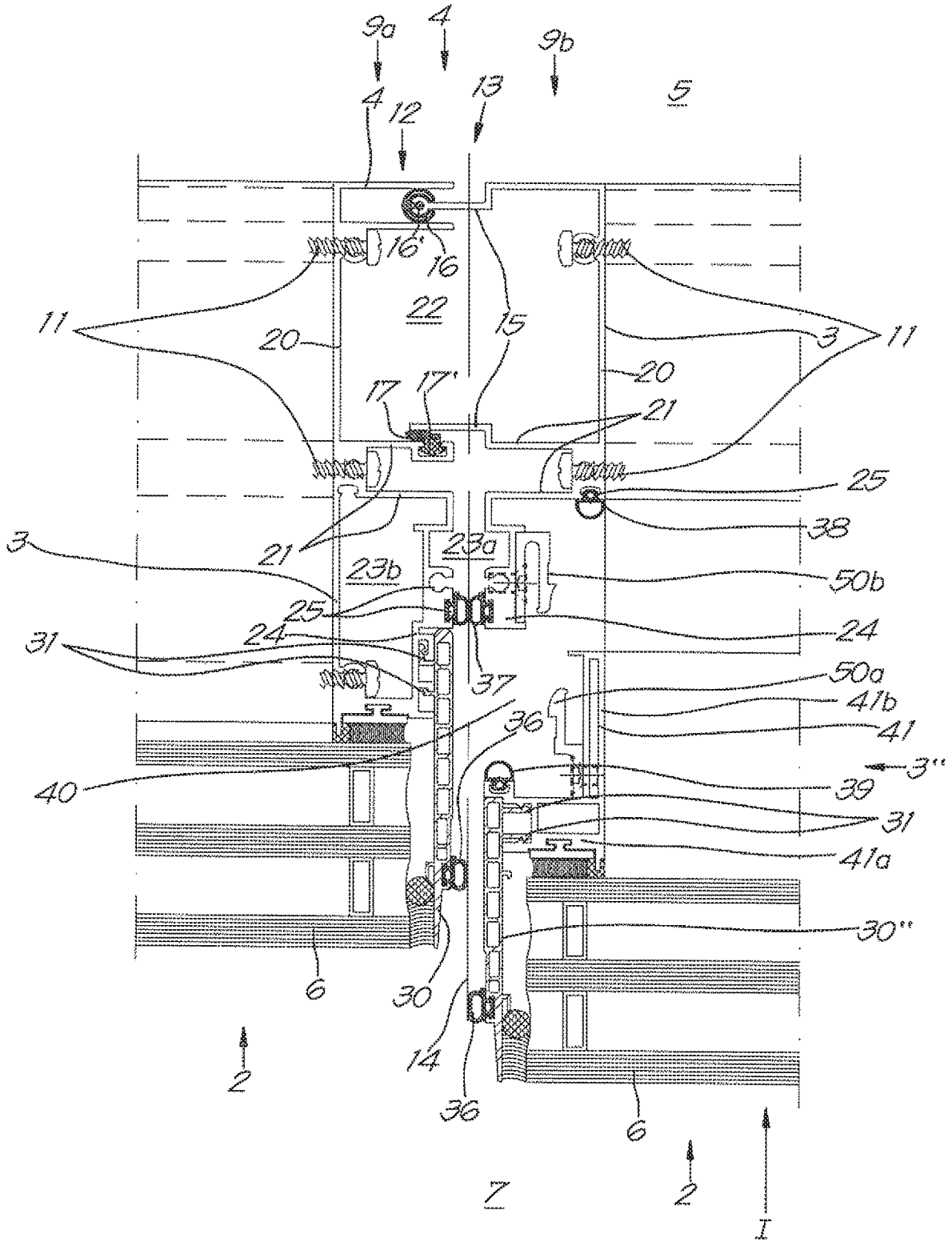
Figure 25:
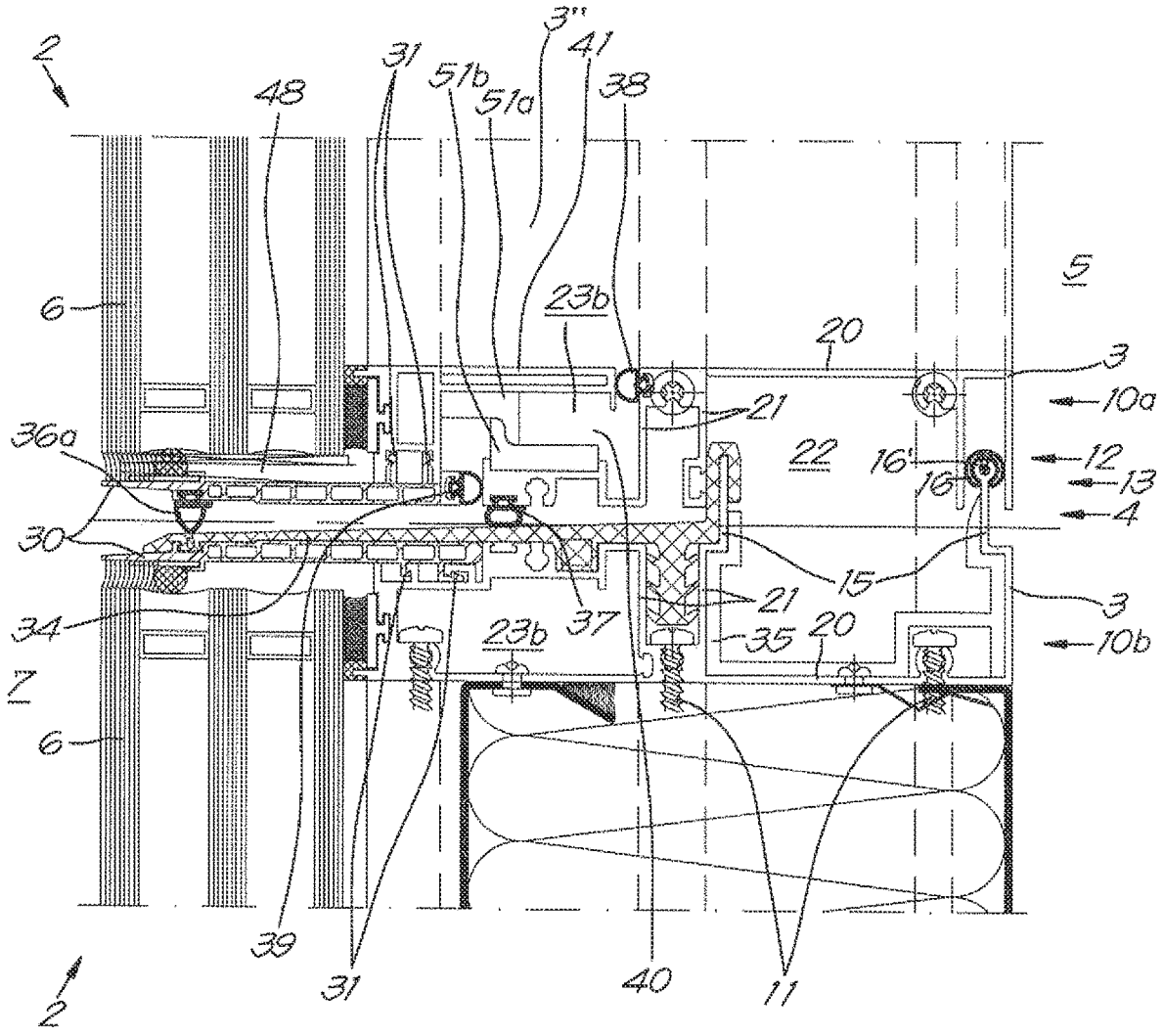
Figure 24:
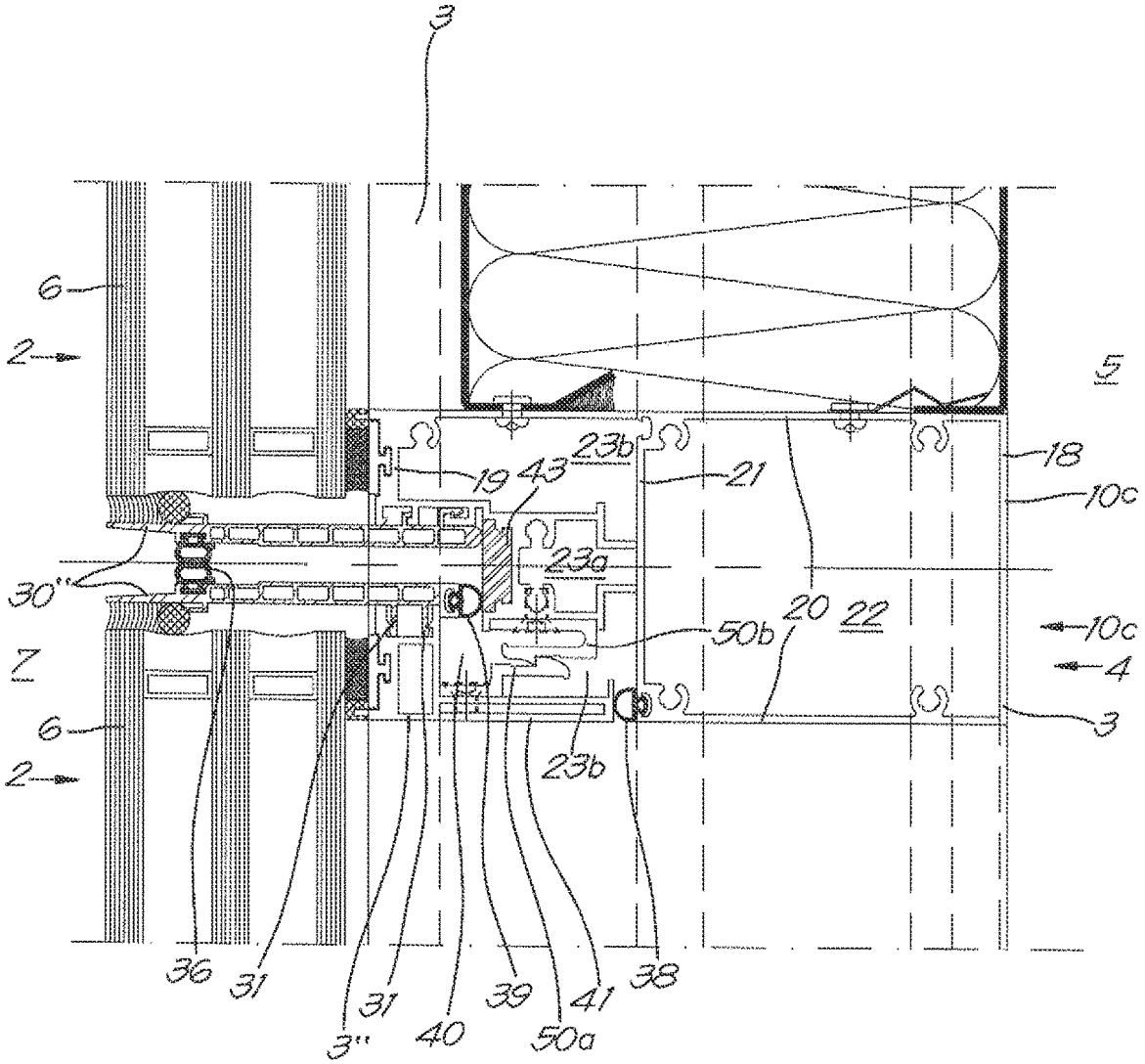

To this end a wing frame 3" with a replacement infill element 6*a* is fabricated beforehand as shown in the FIGS. 22 to 24, similar to the wing frame 3" in FIG. 11 for a wing that opens consisting of L-shaped profiles 41 with the required insulation profiles 30" sealed along the edges of the infill element 6*a* and fitted with seals 36 and 39 all around.

The L-shaped profiles 41 on the leg 41*b* are fitted with a sideways elastic clip connection 50*a* on the vertical profiles 41 as shown in FIG. 22 and on the uppermost profile 41 of the wing frame 3" as shown in FIG. 24 and on the lowest profile 41 of the wing frame 3" a reinforcement lug 51*a* with a downwards-facing lip as shown in FIG. 23.

In order to remove the broken infill element 6*a*, use is first made from the inside of one or several suction cups applied to the inside of the broken infill element in order to hold and manipulate the infill element from the inside.

In doing so the suction cups are attached to the inside of the building making it impossible for the infill element for replacement 6*a* to fall down.

Figure 21:
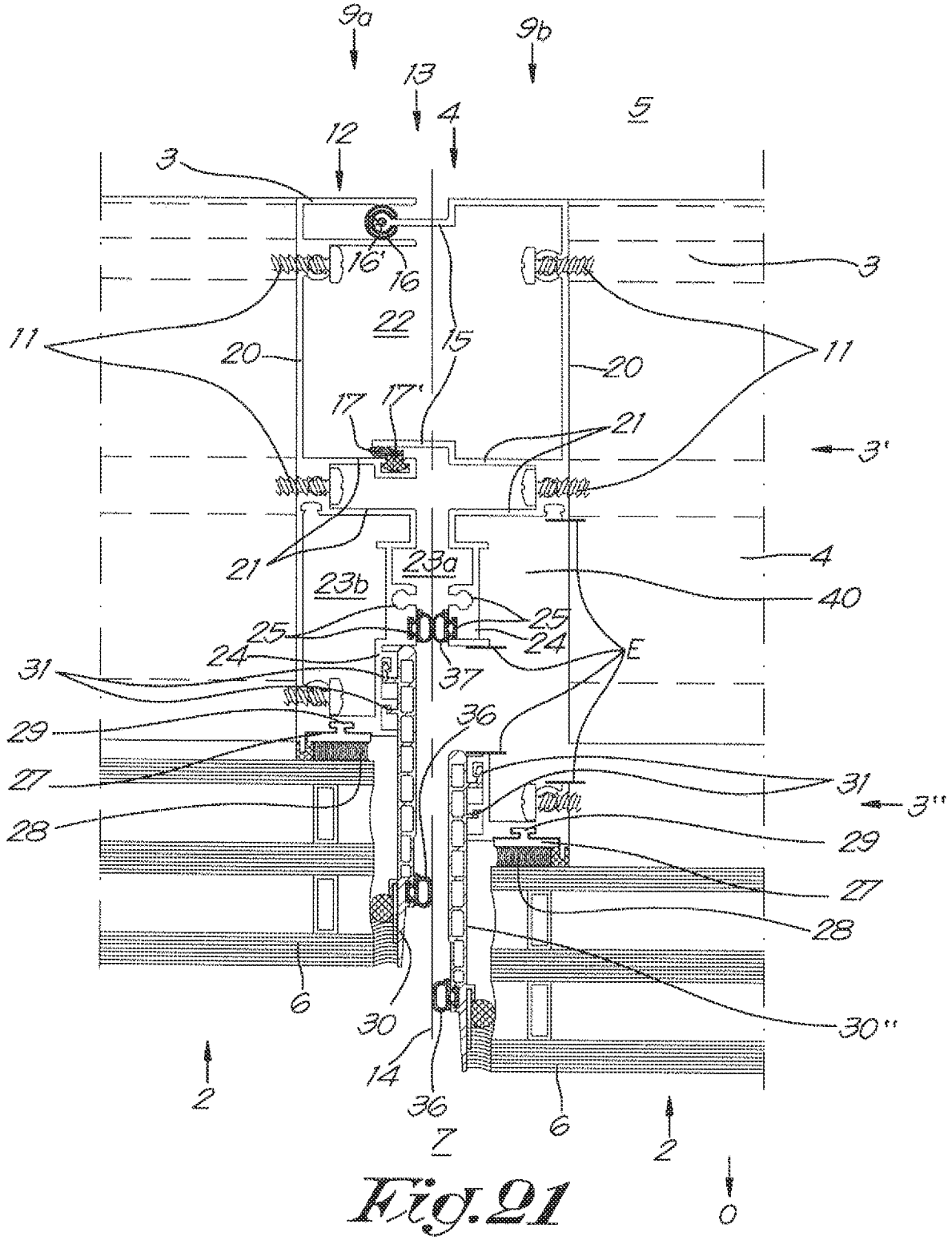
FIGS. 21 and 22 show a cross-section according to the lines XXI-XXI in FIG. 20 during two consecutive steps in the replacement of a cracked or damaged infill element.

Then the basic frame 3 around the broken infill element 6*a* is sawed or cut along the lines E as shown in FIG. 21, whereby the infill element for replacement 6*a* can be removed with a part of the basic frame 3 as shown with arrow O in FIG. 21 and a rebate 40 remains in the remaining part of the basic frame 3.

In the corners of the rebate 40 appropriate corner pieces 44 are applied and one or more, preferably two complementary clip connections 50*b* are attached with screws or the like at the level of the mullions 9 and of the upper transom 10*c* of the compartment 3*a* of the infill element for replacement 6*a* and one or more complementary reinforcement lugs 51*b* on the lower transom 10*a*, each reinforcement lug 51*b* with an upward-facing lip behind which the downward-facing lip of the reinforcement lug 51*a* of the wing with the replacement infill element 2 can be hooked as shown in FIG. 23.

Once the broken infill element 6*a* with the attached cut frame part of the basic frame 3 is removed, a seal 38 is then attached in the remaining detailing 25 on the partition 21 and an insulation slat 43 is attached in the intermediate transom 10*c* as shown in FIG. 24.

All that then needs to be done is to attach the tailor-made prefabricated wing frame 3" with the replacement infill element 6*a* first from the inside in the remaining opening in the curtain wall 1, using the aforementioned suction cups, by turning the wing frame 3" from the inside towards the outside and by placing it with reinforcement lugs 51*a* on its lowest profile 41 on the lowest reinforcement lugs 51*b* in the rebate 40 with the lip of the reinforcement lugs 51*a* hooking behind the lip of the reinforcement lugs 51*b*.

Once the wing frame 3" with replacement infill element is placed horizontally in the correct position, this wing frame 3" resting on the reinforcement lugs 51*a* and 51*b* is tipped inside with a rotating pulling movement around the rotation axis through the contact line between the lugs 51*a* and 51*b* as shown with arrow I in FIG. 22, and clipped tight in the curtain wall 1 by hooking the elastic clip connections 50*a* and 50*b* into each other as shown in the FIGS. 22 and 24.

The reinforcement lugs 51*a* and 51*b* are shaped in such a way that the wing frame 3" slides easily into the correct position in the rebate 40 or the basic frame 3.

Throughout the entire operation the installers are inside the building.

The present invention is in no way limited to the example described and the embodiment shown in the figures of a modular curtain wall according to the invention and related wall elements and method for the fabrication of this kind of wall element, but such curtain wall and wall element according to the invention can be realised in all kinds of forms and dimensions without departing from the scope of the invention.

The invention claimed is:

1. A wall element and a horizontal seal for use in a curtain wall of a modular type, wherein the wall element is prefabricated and connected to wall elements mounted in rows next to and above one another, wherein the wall element comprises a frame on an inside of the wall element and one or more infill elements that are attached against an outside of the frame on an outside of the wall element, wherein the frame and the inside of the wall element are located on the inside of the curtain wall in an assembled condition of the curtain wall, wherein the one or more infill elements and the outside of the wall element are located on the outside of the curtain wall in the assembled condition of the curtain wall, wherein the frame contains mullions and transoms in the form of profiles which along the perimeter of the frame have female coupling parts and male coupling parts which are such that adjacent mullions and adjacent transoms in the assembled condition in the curtain wall telescopically engage with their coupling parts to form composite basic profiles, wherein the transoms of the frame comprise a lower transom and an upper transom, wherein the lower transom of the frame is provided with the female coupling part and the upper transom of the frame is provided with the male coupling part, the male coupling part being complementary with the female coupling part, wherein the horizontal seal is applied between an underlying wall element of an underlying row of the wall elements mounted in rows next to and above one another and an overlying wall element of an overlying row of the wall elements mounted in rows next to and above one another, wherein a length of the horizontal seal is such that it is applied without a break in the horizontal direction overlapping several sideways adjacent wall elements, wherein the horizontal seal comprises a part with which the horizontal seal rest on the underlying wall element, wherein the horizontal seal comprises an upstanding edge, wherein the upstanding edge extends into the female coupling part of the lower transom of the overlying wall element, wherein the upstanding edge is clamped between a surface of the male coupling part of the upper transom of the underlying wall element and the female coupling part of the lower transom of the overlying wall element.

2. The wall element and the horizontal seal according to claim 1, wherein the male coupling part of the upper transom of the underlying wall element comprises a U-shaped part with upstanding legs that extend into the female coupling part of the lower transom of the overlying wall element, and wherein the upstanding edge of the horizontal seal is fitted with a hook-shaped bent end that grips over one of the upstanding legs.

3. The wall element and the horizontal seal according to claim 1, wherein the part with which the horizontal seal rests on the underlying wall element extends from the upstanding edge outward and thereby at least partially overlaps the infill elements breadthways.

4. The wall element and the horizontal seal according to claim 3, wherein the part with which the horizontal seal rests on the underlying wall element extends from the upstanding edge outward up to or almost up to the outside of the wall element.

5. The wall element and the horizontal seal according to claim 1, wherein the part with which the horizontal seal rests on the underlying wall element slopes to the outside of the wall element to allow the transit of water.

6. The wall element and the horizontal seal according to claim 1, wherein the horizontal seal on an underside is fitted with a downward facing profiling which clamps tightly into a groove of the upper transom of the underlying wall element.

7. The wall element and the horizontal seal according to claim 1, wherein the horizontal seal is made of a flexible material that can be rolled out.

8. The wall element and the horizontal seal according to claim 1, wherein the wall element is fitted along the perimeter of the one or more infill elements with insulation profiles which are attached to the frame and which extend from the frame to the outside of the wall element over a lateral edge of the one or more infill elements.

9. The wall element and the horizontal seal according to claim 8, wherein the insulation profiles are sealed against the one or more infill elements using a silicone or other sealing kit.

10. The wall element and the horizontal seal according to claim 8, wherein the horizontal seal extends from the inside of the wall element to the outside of the wall element between the insulation profiles.

11. The wall element and the horizontal seal according to claim 8, wherein the horizontal seal comprises an outward facing edge along which the horizontal seal is clamped on an insulation profile of the underlying wall element.

12. The wall element and the horizontal seal according to claim 8, wherein the insulation profiles are fitted along an outside perimeter with a first level of seals at a fixed distance from the outside of the wall element, wherein the first level of seals ensures a seal between adjoining wall elements of the wall elements mounted in rows next to and above one another in the assembled condition of the curtain wall, and wherein the first level of seals ensures a seal between the overlying wall element and the horizontal seal.

13. The wall element and the horizontal seal according to claim 12, wherein a second level of seals is fitted on the frame of the wall element at a greater distance from the outside of the wall element when compared to the first level of seals, wherein the second level of seals ensures a seal between adjoining wall elements of the wall elements mounted in rows next to and above one another in the assembled condition of the curtain wall, and wherein the second level of seals ensures a seal between the overlying wall element of and the horizontal seal.

14. The wall element and the horizontal seal according to claim 13, wherein a third level of seals is fitted on the mullions, wherein the third level of seals ensures a seal between adjoining wall elements of the wall elements mounted in rows next to and above one another in the assembled condition of the curtain wall, wherein the third level of seals connects with the upstanding edge of the horizontal seal, and wherein the upstanding edge forms the third level seal between the lower transom of the overlying wall element and the upper transom of the underlying wall element.

15. The wall element and the horizontal seal according to claim 14, wherein the male coupling part of the wall element is provided with a leg which along a free edge has a fourth level seal which is slid to fit in a groove of the female coupling part of an adjoining wall element of the wall elements mounted in rows next to and above one another in the assembled condition of the curtain wall, wherein the fourth level seal is located closer to the inside of the wall element vis-a-vis the third level seal.

16. The wall element and the horizontal seal according to claim 15, wherein the third level of seals and/or the fourth level of seals are coextruded seals of rubber combined with a stiff foot which allows the seals on assembly of the wall elements to be slid lengthways in a groove of the profiles.

17. The wall element and the horizontal seal according to claim 1, wherein the transoms of the frame of the wall element comprise an intermediate transom which connects the mullions of the wall element with each other and divides the frame into two compartments one above the other, wherein the wall element comprises two infill elements of the one or more infill elements and each of the two compartments has one of the two infill elements.

18. The wall element and the horizontal seal according to claim 17, wherein between the two infill elements of the prefabricated wall element an insulation profile is provided which is attached to the intermediate transom and sealed against the two infill elements using silicones or other sealing kit.

19. The wall element and the horizontal seal according to claim 1, wherein the mullions and the transoms have perpendicular ends, wherein the transoms extend between the mullions and are connected with them in perpendicular connections by means of screws, wherein the horizontal seal extends over the perpendicular connections between the transoms and mullions of adjacent underlying wall elements of the wall elements mounted in rows next to and above one another in the assembled condition of the curtain wall.

20. The wall element and the horizontal seal according to claim 1, wherein the one or more infill elements are attached to the frame by means of aluminum slats that have been slid with a foot lengthways in a complementary groove of the profiles and against which the one or more infill elements are attached using structural glue.

* * * * *